US009390679B2

(12) United States Patent
Harada et al.

(10) Patent No.: US 9,390,679 B2
(45) Date of Patent: Jul. 12, 2016

(54) DISPLAY DEVICE, ELECTRONIC APPARATUS, DRIVING METHOD OF DISPLAY DEVICE, AND SIGNAL PROCESSING METHOD

(71) Applicant: Japan Display Inc., Tokyo (JP)

(72) Inventors: Tsutomu Harada, Tokyo (JP); Masaaki Kabe, Tokyo (JP); Fumitaka Goto, Tokyo (JP); Toshiyuki Nagatsuma, Tokyo (JP)

(73) Assignee: Japan Display Inc., Tokyo (JP)

( * ) Notice: Subject to any disclaimer, the term of this patent is extended or adjusted under 35 U.S.C. 154(b) by 165 days.

(21) Appl. No.: 14/184,819

(22) Filed: Feb. 20, 2014

(65) Prior Publication Data

US 2014/0267471 A1 Sep. 18, 2014

(30) Foreign Application Priority Data

Mar. 13, 2013 (JP) ..... 2013-050761

(51) Int. Cl.
*G09G 5/10* (2006.01)
*G09G 5/04* (2006.01)
*G09G 3/34* (2006.01)

(52) U.S. Cl.
CPC ..... *G09G 5/04* (2013.01); *G09G 3/342* (2013.01); *G09G 2320/0242* (2013.01); *G09G 2320/062* (2013.01); *G09G 2320/0646* (2013.01); *G09G 2320/0666* (2013.01)

(58) Field of Classification Search
CPC ..... G09G 2300/0452; G09G 3/3607; G09G 2340/0457; G09G 3/2003; G09G 3/20; G09G 2340/06
USPC ..... 345/690, 694
See application file for complete search history.

(56) References Cited

U.S. PATENT DOCUMENTS

2011/0181635 A1* 7/2011 Kabe ..... G09G 3/3426 345/694
2013/0106901 A1* 5/2013 Inada ..... G09G 3/3406 345/600

(Continued)

FOREIGN PATENT DOCUMENTS

JP 2004-004532 1/2004
JP 2010-033009 A 2/2010

(Continued)

OTHER PUBLICATIONS

Japanese Patent Office Action for Application No. 2013-050761 dated Aug. 4, 2015 (9 pages).

*Primary Examiner* — Lixi C Simpson
*Assistant Examiner* — Ngan T Pham Lu
(74) *Attorney, Agent, or Firm* — Michael Best & Friedrich LLP

(57) ABSTRACT

According to an aspect, a display device includes: an image display panel; a signal processing unit; and a signal processing circuit. The signal processing unit calculates an extension coefficient α for an input signal, calculates an output signal of a first sub-pixel, calculates an output signal of a second sub-pixel, calculates an output signal of a third sub-pixel, calculates an output signal of a fourth sub-pixel, and calculates a control signal. The signal processing circuit performs filtering processing on the control signal by a set first time constant to calculate and output a light-source device control signal, when the control signal is smaller than a set threshold value, and performs filtering processing on the control signal by a set second time constant to calculate and output the light-source device control signal, when the control signal is equal to or larger than the threshold value.

14 Claims, 19 Drawing Sheets

(56) References Cited

U.S. PATENT DOCUMENTS

| | | | | |
|---|---|---|---|---|
| 2014/0125689 | A1* | 5/2014 | Ikeda | G09G 5/02 345/591 |
| 2014/0176623 | A1* | 6/2014 | Inoue | G09G 3/2003 345/690 |

FOREIGN PATENT DOCUMENTS

| | | |
|---|---|---|
| JP | 2010-169768 | 8/2010 |
| JP | 2011-248352 | 12/2011 |
| JP | 2013-029720 | 2/2013 |

* cited by examiner

DISPLAY DEVICE, ELECTRONIC APPARATUS, DRIVING METHOD OF DISPLAY DEVICE, AND SIGNAL PROCESSING METHOD

CROSS-REFERENCE TO RELATED APPLICATIONS

This application claims priority from Japanese Application No. 2013-050761, filed on Mar. 13, 2013, the contents of which are incorporated by reference herein in its entirety.

BACKGROUND

1. Technical Field

The present disclosure relates to a display device and a driving method thereof. The present disclosure also relates to an electronic apparatus that includes the display device. The present disclosure also relates to a signal processing method in the display device.

2. Description of the Related Art

In recent years, there has been an increasing demand for a display device for mobile apparatuses such as portable phones and electronic papers. In the display device, one pixel includes plural sub-pixels. The sub-pixels respectively output light of colors that differ from each other. One pixel can display various colors by switching ON/OFF the display of each of the sub-pixels. In some of the display devices, four sub-pixels including a white-color sub-pixel constitute one pixel (see Japanese Patent Application Laid-open Publications No. 2010-33009 (JP-A-2010-33009) and No. 2011-248352 (JP-A-2011-248352).

JP-A-2010-33009 describes a display device that includes an image display panel constituted by arraying pixels in a two-dimensional matrix, each of which is configured by first, second, third, and fourth sub-pixels, and a signal processing unit that accepts an input signal and outputs an output signal. The display device can add a fourth color to three primary colors to enlarge an HSV color space as compared to the case of the three primary colors. The signal processing unit has a maximum value Vmax(S) of brightness, where saturation S is a variable, stored therein, and obtains the saturation S and brightness V(S) based on a signal value of the input signal, and obtains an extension coefficient $\alpha$ based on at least one of values of Vmax(S)/V(S). The signal processing unit obtains an output signal value to the fourth sub-pixel based on at least respective input signal values to the first, second, and third sub-pixels, and calculates respective output signal values to the first, second, and third sub-pixels based on the input signal values, the extension coefficient $\alpha$, and the fourth output signal value.

JP-A-2011-248352 describes a display device that includes a display panel in which plural pixels are provided, each of which includes sub-pixels that respectively include red, green, and blue color filters, and a sub-pixel that controls the light transmission of a white light, a backlight unit that includes red, green, blue and white light sources, an image switching circuit that switches the display mode of the display panel between a moving-image mode and a still-image mode, and a display control circuit that controls the luminance of red, green, and blue in the backlight unit according to an image signal in the moving-image mode, and that controls the luminance of the white light source in the backlight unit according to an image signal in the still-image mode.

As described in JP-A-2010-33009 and JP-A-2011-248352, an image signal is extended corresponding to an HSV region that is expanded by one sub-pixel (basically a white sub-pixel) of plural sub-pixels based on the image signal, to reduce the light amount of the light source and reproduce a desired image. An image can be brighter without increasing the light amount of the light source.

However, there is a case where an image viewer can recognize a change in the image when the light amount of the light source is changed. Therefore, it is preferable to control the light amount of the light source appropriately.

Japanese Patent Application Laid-open Publication No. 2010-169768 (JP-A-2010-169768) describes a video display device that calculates saturation based on signal values of video input signals of plural colors, that sets a value as a time constant that becomes larger as the saturation is higher, and that controls the light amount to be emitted from a white light source based on a target light amount and the time constant. However, the control of the light amount described in JP-A-2010-169768 is not appropriate in a case where the HSV region is expanded as described in JP-A-2010-33009 and JP-A-2011-248352.

For the foregoing reasons, there is a need for a display device, an electronic apparatus, a driving method of the display device, and a signal processing method capable of preventing an image viewer from recognizing a change in an image when an HSV color space is expanded.

SUMMARY

According to an aspect, a display device includes: an image display panel in which pixels are arrayed in a two-dimensional matrix, each of the pixels including a first sub-pixel that displays a first color, a second sub-pixel that displays a second color, a third sub-pixel that displays a third color, and a fourth sub-pixel that displays a fourth color; a signal processing unit that converts an input value of an input HSV color space of an input signal into an extension value of an extended HSV color space that is extended by the first color, the second color, the third color, and the fourth color to generate an output signal of the extension value, that outputs the generated output signal to the image display panel, and that outputs a control signal for controlling luminance of the image display panel; and a signal processing circuit that performs signal processing on the control signal to output a light-source device control signal for controlling a light-source device that illuminates the image display panel. The signal processing unit calculates an extension coefficient $\alpha$ for the input signal, calculates an output signal of the first sub-pixel based on at least an input signal of the first sub-pixel and the extension coefficient $\alpha$, and outputs the output signal to the first sub-pixel, calculates an output signal of the second sub-pixel based on at least an input signal of the second sub-pixel and the extension coefficient $\alpha$, and outputs the output signal to the second sub-pixel, calculates an output signal of the third sub-pixel based on at least an input signal of the third sub-pixel and the extension coefficient $\alpha$, and outputs the output signal to the third sub-pixel, calculates an output signal of the fourth sub-pixel based on the input signal of the first sub-pixel, the input signal of the second sub-pixel, and the input signal of the third sub-pixel, and outputs the output signal to the fourth sub-pixel, and calculates the control signal based on at least the extension coefficient $\alpha$, and outputs the control signal to the signal processing circuit. The signal processing circuit performs filtering processing on the control signal by a set first time constant to calculate and output the light-source device control signal, when the control signal is smaller than a set threshold value, and performs filtering processing on the control signal by a set second time constant to calculate and output the light-source device control signal, when the control signal is equal to or larger than the threshold value.

According to another aspect, an electronic apparatus includes: the display device; and a control device that supplies the input signal to the display device.

According to another aspect, a driving method of a display device that includes an image display panel in which pixels are arrayed in a two-dimensional matrix, where each of the pixels includes a first sub-pixel that displays a first color, a second sub-pixel that displays a second color, a third sub-pixel that displays a third color, and a fourth sub-pixel that displays a fourth color, a signal processing unit that converts an input value of an input HSV color space of an input signal into an extension value of an extended HSV color space that is extended by the first color, the second color, the third color, and the fourth color to generate an output signal of the extension value, that outputs the generated output signal to the image display panel, and that outputs a control signal for controlling luminance of the image display panel, and a signal processing circuit that performs signal processing on the control signal to output a light-source device control signal for controlling a light-source device that illuminates the image display panel, the driving method includes: calculating an extension coefficient $\alpha$ for the input signal; calculating an output signal of the first sub-pixel based on at least an input signal of the first sub-pixel and the extension coefficient $\alpha$, and outputting the output signal to the first sub-pixel, calculating an output signal of the second sub-pixel based on at least an input signal of the second sub-pixel and the extension coefficient $\alpha$, and outputting the output signal to the second sub-pixel, calculating an output signal of the third sub-pixel based on at least an input signal of the third sub-pixel and the extension coefficient $\alpha$, and outputting the output signal to the third sub-pixel, calculating an output signal of the fourth sub-pixel based on the input signal of the first sub-pixel, the input signal of the second sub-pixel, and the input signal of the third sub-pixel, and outputting the output signal to the fourth sub-pixel; and performing filtering processing on the control signal by a set first time constant to calculate and output the light-source device control signal, when the control signal is smaller than a set threshold value, and performing filtering processing on the control signal by a set second time constant to calculate and output the light-source device control signal, when the control signal is equal to or larger than the threshold value.

According to another aspect, a signal processing method in a display device that includes an image display panel in which pixels are arrayed in a two-dimensional matrix, where each of the pixels includes a first sub-pixel that displays a first color, a second sub-pixel that displays a second color, a third sub-pixel that displays a third color, and a fourth sub-pixel that displays a fourth color, a signal processing unit that converts an input value of an input HSV color space of an input signal into an extension value of an extended HSV color space that is extended by the first color, the second color, the third color, and the fourth color to generate an output signal of the extension value, that outputs the generated output signal to the image display panel, and that outputs a control signal for controlling luminance of the image display panel, and a signal processing circuit that performs signal processing on the control signal to output a light-source device control signal for controlling a light-source device that illuminates the image display panel, where the signal processing unit calculates an extension coefficient $\alpha$ for the input signal, and calculates the control signal based on at least the extension coefficient $\alpha$, the signal processing method being executed by the signal processing circuit. When the control signal is smaller than a set threshold value, filtering processing is performed on the control signal by a set first time constant to calculate and output the light-source device control signal, and when the control signal is equal to or larger than the threshold value, filtering processing is performed on the control signal by a set second time constant to calculate and output the light-source device control signal.

DETAILED DESCRIPTION

Hereinafter, an example of implementing a technology of the present disclosure will be described in detail with reference to the accompanying drawings. Explanations are given in the following order.

1. Embodiment

Display Device, Electronic Apparatus, Driving Method of Display Device, and Signal Processing Method One pixel includes a white-color sub-pixel.

An extension coefficient is calculated based on an input signal, and a control signal is generated based on this extension coefficient.

A time constant of a light-source device control signal is set based on the control signal.

2. Application Example

Electronic Apparatus

Example in which a display device according to the embodiment is applied to an electronic apparatus

3. Aspects of the Present Disclosure

1. Embodiment

Figure 1:
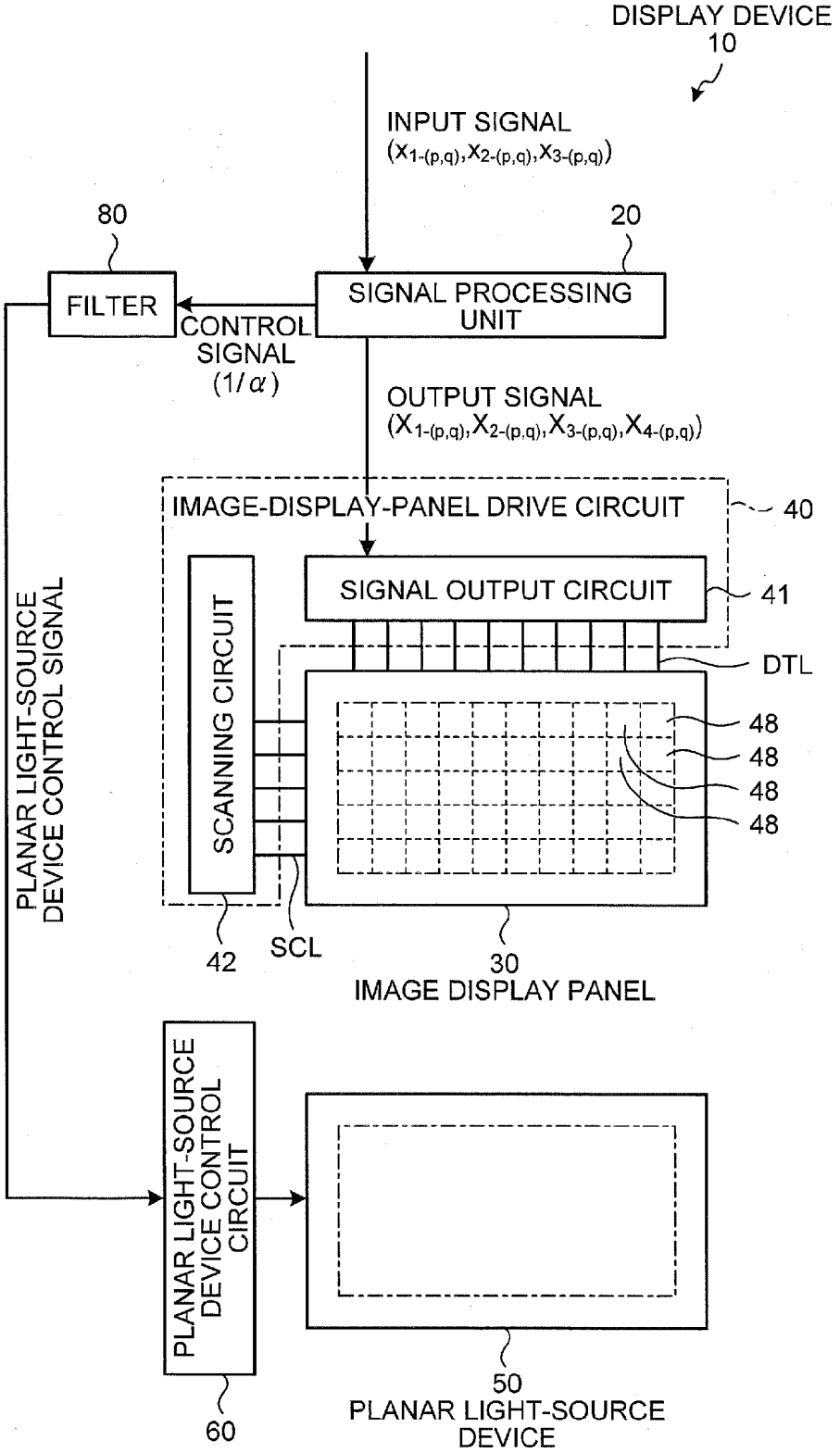
FIG. 1 is a block diagram of a configuration example of a display device according to an embodiment of the present disclosure.
Figure 2:
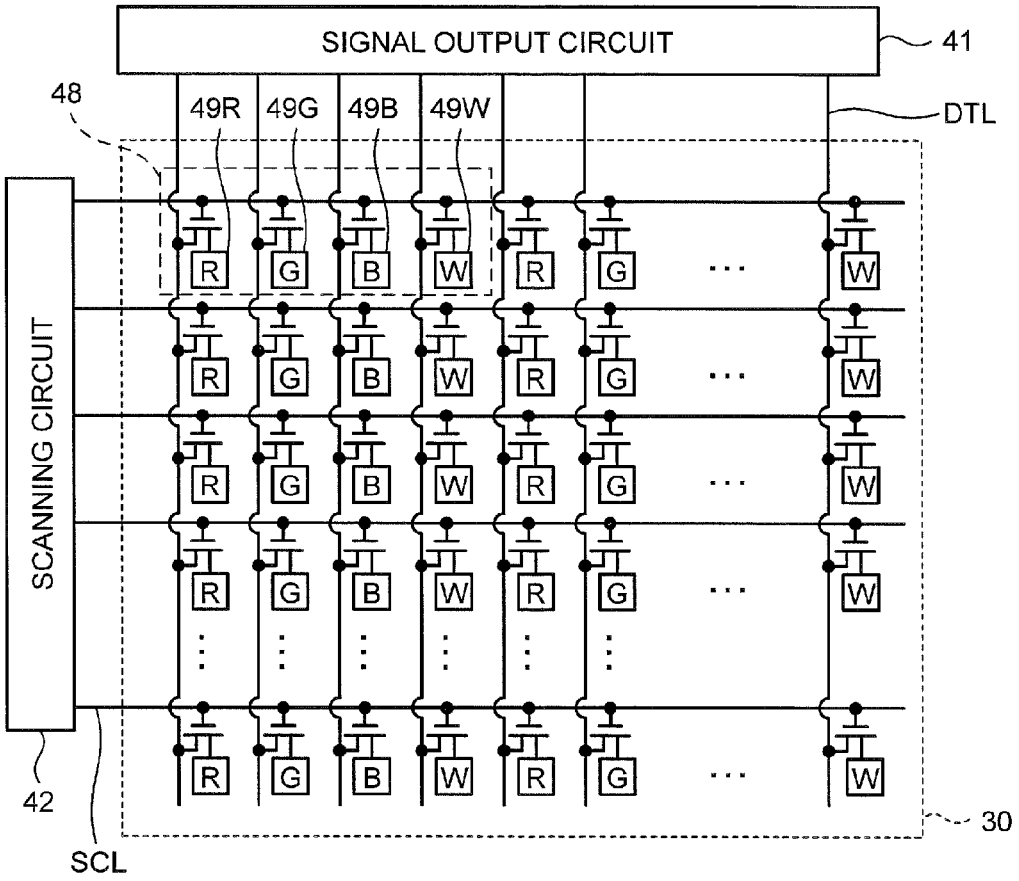
FIG. 2 is a conceptual diagram of an image display panel and an image-display-panel drive circuit in the display device illustrated in FIG. 1.

FIG. 1 is a block diagram of a configuration example of a display device according to an embodiment of the present disclosure. FIG. 2 is a conceptual diagram of an image display panel and an image-display-panel drive circuit in the display device in FIG. 1. As illustrated in FIG. 1, a display device 10 according to the present embodiment includes a signal processing unit 20 that transmits a signal to each unit of the display device 10 to control an operation of each unit, an image display panel 30 that displays an image based on an output signal output from the signal processing unit 20, an image-display-panel drive circuit 40 that controls driving of the image display panel 30, a planar light-source device 50 that illuminates the image display panel 30 from its backside, a planar light-source device control circuit 60 that controls driving of the planar light-source device 50, and a filter (signal processing circuit) 80 that performs signal processing on a control signal output from the signal processing unit 20 and output the control signal to the planar light-source device control circuit 60. The display device 10 has the same configuration as an image display device assembly described in Japanese Patent Application Laid-open Publication No. 2011-154323 (JP-A-2011-154323), and various modifications described in JP-A-2011-154323 are applicable to the display device 10.

The signal processing unit 20 is an arithmetic processing unit that controls an operation of each of the image display panel 30 and the planar light-source device 50. The signal processing unit 20 is coupled to the image-display-panel drive circuit 40 and the filter 80. The signal processing unit 20 processes an input signal that is input externally to generate an output signal and a control signal. That is, the signal processing unit 20 converts an input value (an input signal) of an input HSV color space of the input signal into an extension value (an output signal) of an extended HSV color space that is extended by a first color, a second color, a third color, and a fourth color, and generates the output signal. The signal processing unit 20 outputs the generated output signal to the image-display-panel drive circuit 40, and outputs the generated control signal to the filter 80.

As illustrated in FIG. 2, in the image display panel 30, pixels 48 are arrayed in a two-dimensional matrix, where the number of the pixels 48 is $P_0 \times Q_0$ (the number of the pixels 48 in the horizontal direction is $P_0$ and the number of the pixels 48 in the vertical direction is $Q_0$). Each of the pixels 48 includes a first sub-pixel 49R that displays a first primary color (for example, red), a second sub-pixel 49G that displays a second primary color (for example, green), a third sub-pixel 49B that displays a third primary color (for example, blue), and a fourth sub-pixel 49W that displays a fourth color (specifically, white).

More specifically, the display device according to the embodiment is a transmissive color liquid crystal display device. The image display panel 30 is a color liquid crystal display panel, in which a first color filter that passes the first primary color is arranged between the first sub-pixel 49R and an image viewer, a second color filter that passes the second primary color is arranged between the second sub-pixel 49G and the image viewer, and a third color filter that passes the third primary color is arranged between the third sub-pixel 49B and the image viewer. In the image display panel 30, no color filter is arranged between the fourth sub-pixel 49W and the image viewer. The fourth sub-pixel 49W can be provided with a transparent resin layer instead of the color filter. By providing the transparent resin layer as described above, the image display panel 30 can prevent generating a sharp step on the fourth sub-pixel 49W due to the absence of the color filter in the fourth sub-pixel 49W.

In an example illustrated in FIG. 2, in the image display panel 30, the first sub-pixel 49R, the second sub-pixel 49G, the third sub-pixel 49B, and the fourth sub-pixel 49W are arranged in an array similar to a stripe array. The configuration and arrangement of sub-pixels included in one pixel are not particularly limited. In the image display panel 30, the first sub-pixel 49R, the second sub-pixel 49G, the third sub-pixel 49B, and the fourth sub-pixel 49W can also be arranged in an array similar to a diagonal array (a mosaic array). For example, an array similar to a delta array (a triangle array), an array similar to a rectangle array, or the like can also be employed. Generally, the array similar to the stripe array is preferable for personal computers and the like to display data and text. In contrast thereto, the array similar to the mosaic array is preferable for video camera recorders, digital still cameras, and the like to display natural images.

The image-display-panel drive circuit 40 includes a signal output circuit 41 and a scanning circuit 42. In the image-display-panel drive circuit 40, the signal output circuit 41 holds therein video signals, and sequentially output the video signals to the image display panel 30. The signal output circuit 41 is electrically coupled to the image display panel 30 by a wiring DTL. In the image-display-panel drive circuit 40, the scanning circuit 42 controls ON/OFF of a switching element (for example, a TFT) that controls an operation (the light transmission rate) of a sub-pixel in the image display panel 30. The scanning circuit 42 is electrically coupled to the image display panel 30 by a wiring SCL.

The planar light-source device 50 is arranged at the backside of the image display panel 30, and irradiates light toward the image display panel 30 to illuminate the image display panel 30. The planar light-source device 50 irradiates light on the entire surface of the image display panel 30 to make the image display panel 30 brighter.

The planar light-source device control circuit 60 controls the amount of light to be output from the planar light-source device 50, and the like. Specifically, based on a planar light-source device control signal that is output from the filter 80, the planar light-source device control circuit 60 adjusts the voltage to be supplied to the planar light-source device 50, and the like to control the amount of light (the light intensity) irradiated on the image display panel 30.

The filter (signal processing circuit) 80 performs signal processing described later on the control signal that is input from the signal processing unit 20 to generate and output a planar light-source device control signal to the planar light-source device control circuit 60.

Figure 3:
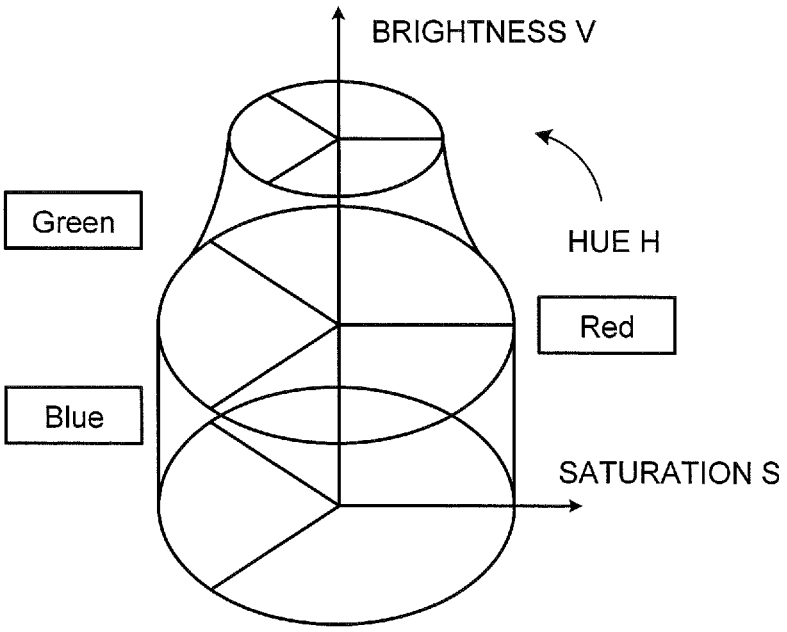
FIG. 3 is a conceptual diagram of an extended HSV color space that is extendable by the display device according to the embodiment.
Figure 4:
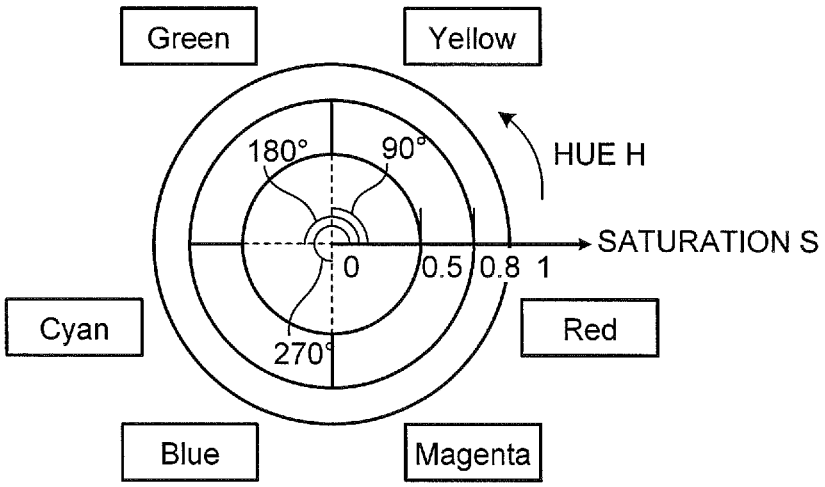
FIG. 4 is a conceptual diagram illustrating a relationship between hue and saturation in an extended HSV color space.
Figure 5:
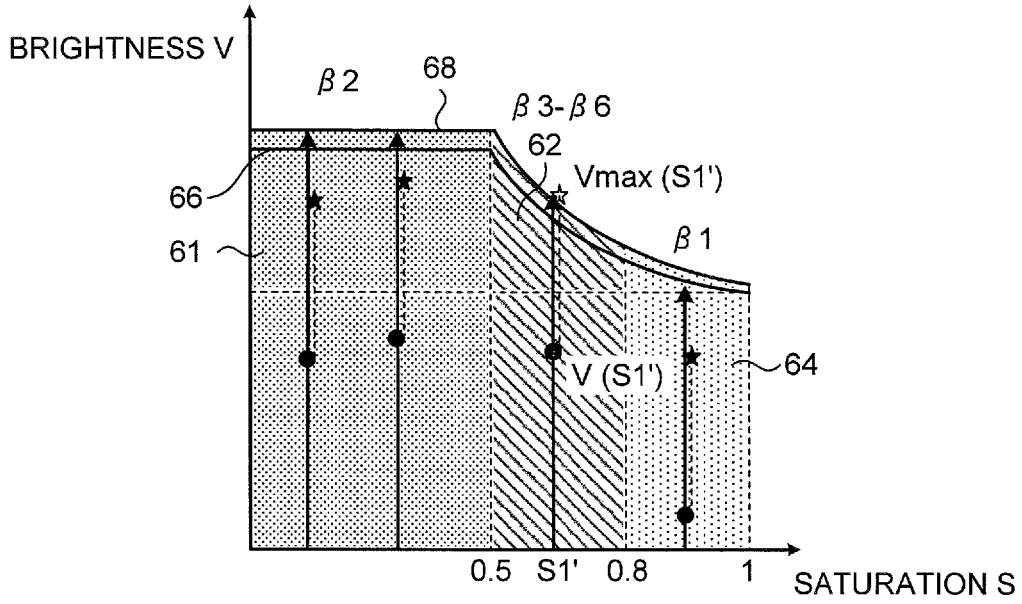
FIG. 5 is a conceptual diagram illustrating a relationship between saturation and brightness in an extended HSV color space.
Figure 6:
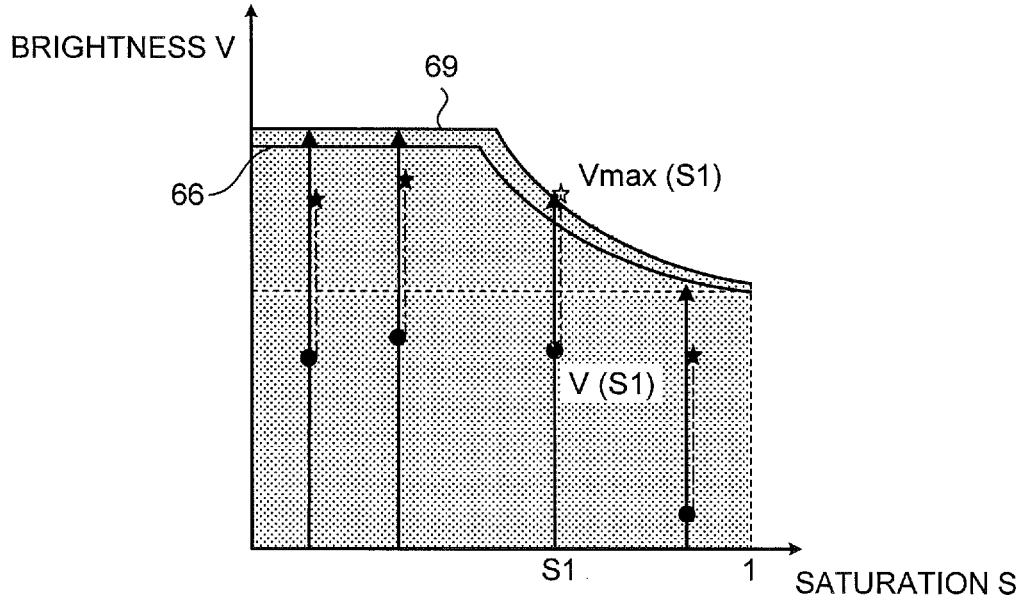
FIG. 6 is a conceptual diagram illustrating a relationship between saturation and brightness in an extended HSV color space that is not divided.

Next, a processing operation performed by the signal processing unit 20 will be explained below with reference to FIGS. 3 to 6. FIG. 3 is a conceptual diagram of an extended HSV color space that is extendable by the display device according to the embodiment. FIG. 4 is a conceptual diagram illustrating a relationship between hue and saturation in the extended HSV color space. FIG. 5 is a conceptual diagram illustrating a relationship between saturation and brightness in the extended HSV color space. FIG. 6 is a conceptual diagram illustrating a relationship between saturation and brightness in an extended HSV color space that is not divided.

An input signal that is display image information is externally input to the signal processing unit 20. The input signal includes information for each pixel regarding an image (a color) to be displayed at the position of the pixel. Specifically, signals for the (p,q)th pixel (where $1 \leq p \leq P_0$ and $1 \leq q \leq Q_0$), including a first sub-pixel input signal with a signal value of $x_{1-(p,q)}$, a second sub-pixel input signal with a signal value of $x_{2-(p,q)}$, and a third sub-pixel input signal with a signal value of $x_{3-(p,q)}$, are input to the signal processing unit 20.

The signal processing unit 20 processes the input signal to generate a first sub-pixel output signal (a signal value $X_{1-(p,q)}$) for deciding display gradation of the first sub-pixel 49R, a second sub-pixel output signal (a signal value $X_{2-(p,q)}$) for deciding display gradation of the second sub-pixel 49G, a third sub-pixel output signal (a signal value $X_{3-(p,q)}$) for deciding display gradation of the third sub-pixel 49B, and a fourth sub-pixel output signal (a signal value $X_{4-(p,q)}$) for deciding display gradation of the fourth sub-pixel 49W, and to output these output signals to the image-display-panel drive circuit 40.

The display device 10 includes the fourth sub-pixel 49W that outputs a fourth color (white) to the pixel 48 to expand the dynamic range of brightness in an HSV color space (an extended HSV color space) as illustrated in FIG. 3. That is, as illustrated in FIG. 3, a three-dimensional body is placed on a cylindrical-shaped HSV color space that can be displayed by the first sub-pixel, the second sub-pixel, and the third sub-pixel, and the three-dimensional body has a substantially trapezoidal shape with its oblique side being curved in a cross section that includes the saturation axis and the brightness axis, where as the saturation becomes higher, the maximum value of the brightness becomes smaller. A maximum value Vmax(S) of brightness, where saturation S in the HSV color space enlarged by adding the fourth color (white) is a variable, is stored in the signal processing unit 20. That is, the signal processing unit 20 stores therein the maximum value Vmax(S) of brightness for each coordinates (values) of the saturation and the hue for the three-dimensional shape of the HSV color space illustrated in FIG. 3. Because the input signal is constituted by the input signals of the first sub-pixel 49R, the second sub-pixel 49G, and the third sub-pixel 49B, an HSV color space of the input signal has a cylindrical shape, that is, has the same shape as a cylindrical-shaped portion of the extended HSV color space.

Next, the signal processing unit 20 calculates the first sub-pixel output signal (the signal value $X_{1-(p,q)}$) based on at least the first sub-pixel input signal (the signal value $x_{1-(p,q)}$) and the extension coefficient $\alpha$, and outputs the first sub-pixel output signal to the first sub-pixel 49R. The signal processing unit 20 calculates the second sub-pixel output signal (the signal value $X_{2-(p,q)}$) based on at least the second sub-pixel input signal (the signal value $x_{2-(p,q)}$) and the extension coefficient $\alpha$, and outputs the second sub-pixel output signal to the second sub-pixel 49G. The signal processing unit 20 calculates the third sub-pixel output signal (the signal value $X_{3-(p,q)}$) based on at least the third sub-pixel input signal (the signal value $x_{3-(p,q)}$) and the extension coefficient $\alpha$, and outputs the third sub-pixel output signal to the third sub-pixel 49B. The signal processing unit 20 calculates the fourth sub-pixel output signal (the signal value $X_{4-(p,q)}$) based on the first sub-pixel input signal (the signal value $x_{1-(p,q)}$), the second sub-pixel input signal (the signal value $x_{2-(p,q)}$), and the third sub-pixel input signal (the signal value $x_{3-(p,q)}$), and outputs the fourth sub-pixel output signal to the fourth sub-pixel 49W.

Specifically, the first sub-pixel output signal is calculated based on the first sub-pixel input signal, the extension coefficient $\alpha$, and the fourth sub-pixel output signal. Also, the second sub-pixel output signal is calculated based on the second sub-pixel input signal, the extension coefficient $\alpha$, and the fourth sub-pixel output signal. Also, the third sub-pixel output signal is calculated based on the third sub-pixel input signal, the extension coefficient $\alpha$, and the fourth sub-pixel output signal.

That is, when $\chi$ is a constant dependent on a display device, the signal processing unit 20 obtains the first sub-pixel output signal value $X_{1-(p,q)}$, the second sub-pixel output signal value $X_{2-(p,q)}$, and the third sub-pixel output signal value $X_{3-(p,q)}$ for the (p,q)th pixel (or a set of the first sub-pixel 49R, the second sub-pixel 49G, and the third sub-pixel 49B) from the following equations, respectively.

$$X_{1-(p,q)} = \alpha \cdot x_{1-(p,q)} - \chi \cdot X_{4-(p,q)}$$

$$X_{2-(p,q)} = \alpha \cdot x_{2-(p,q)} - \chi \cdot X_{4-(p,q)}$$

$$X_{3-(p,q)} = \alpha \cdot x_{3-(p,q)} - \chi \cdot X_{4-(p,q)}$$

The signal processing unit 20 obtains the maximum value Vmax(S) of brightness, where the saturation S in the HSV color space enlarged by adding the fourth color is a variable, obtains the saturation S and the brightness V(S) of plural pixels based on input signal values of sub-pixels of these pixels, and decides the extension coefficient $\alpha$ such that the proportion of pixels, in which the value of the extended brightness obtained from the product of the brightness V(S) and the extension coefficient $\alpha$ exceeds the maximum value Vmax(S), relative to all pixels, is equal to or lower than a limit proportion value $\beta$. That is, the signal processing unit 20 decides the extension coefficient $\alpha$ within a range where a value exceeding the maximum value of brightness, of the values of the extended brightness, does not exceed a value obtained by multiplying the maximum value Vmax(S) by the limit proportion value $\beta$. The limit proportion value $\beta$ is an upper limit value (proportion) of a proportion of a range exceeding a maximum value of brightness in the extended HSV color space in a combination of hue and saturation value, to the maximum value.

The saturation S is expressed as S=(Max−Min)/Max, and the brightness V(S) is expressed as V(S)=Max. The value of the saturation S can be from 0 to 1, and the value of the brightness V(S) can be from 0 to $(2^n-1)$, where n is the number of display gradation bits. Max is a maximum value of three sub-pixel input signal values that are a first sub-pixel input signal value, a second sub-pixel input signal value, and a third sub-pixel input signal value for a pixel. Min is a minimum value of three sub-pixel input signal values that are the first sub-pixel input signal value, the second sub-pixel input signal value, and the third sub-pixel input signal value for a pixel. Hue H is expressed by an angle from 0° to 360° as illustrated in FIG. 4. As the angle changes from 0° to 360°, the hue H becomes red, yellow, green, cyan, blue, magenta, and red. In the embodiment, the region including the angle 0° is red, the region including the angle 120° is green, and the region including the angle 240° is blue.

The signal processing unit 20 divides the HSV color space (the extended HSV color space) illustrated in FIG. 3 into plural spaces (color spaces) based on at least one of the saturation S, the hue H, and the brightness V, and sets the limit proportion value β for each of divided spaces.

For example, as illustrated in FIGS. 4 and 5, the signal processing unit 20 sets a limit proportion value β1 for a space, where the hue H is included within 0≤H<360, the saturation S is included within 0.8≤S, and the brightness V is included within 0≤V≤Max, to 0.01 (1%). Also, the signal processing unit 20 sets a limit proportion value β2 for a space, where the hue H is included within 0≤H<360, the saturation S is included within S≤0.5, and the brightness V is included within 0≤V≤Max, to 0.01 (1%). Also, the signal processing unit 20 sets a limit proportion value β3 for a space, where the hue H is included within 0≤H<90, the saturation S is included within 0.5<S<0.8, and the brightness V is included within 0≤V≤Max, to 0.025 (2.5%). Also, the signal processing unit 20 sets a limit proportion value β4 for a space, where the hue H is included within 90≤H<180, the saturation S is included within 0.5<S<0.8, and the brightness V is included within 10≤V≤Max, to 0.025 (2.5%). Also, the signal processing unit 20 sets a limit proportion value β5 for a space, where the hue H is included within 180≤H<270, the saturation S is included within 0.5<S<0.8, and the brightness V is included within 10≤V≤Max, to 0.025 (2.5%). Also, the signal processing unit 20 sets a limit proportion value β6 for a space, where the hue H is included within 270≤H<360, the saturation S is included within 0.5<S<0.8, and the brightness V is included within 10≤V≤Max, to 0.025 (2.5%).

That is, in the embodiment, the limit proportion value β when the saturation S is included within 0.5<S<0.8 is different from the limit proportion value β when the saturation S is not included within 0.5<S<0.8 (that is, S≤0.5 or 0.8≤S). Therefore, as illustrated in FIG. 5, a space 61 where S≤0.5, a space 62 where 0.5<S<0.8, and a space 64 where 0.8≤S have different relationships with a limit value line 68 that shows a limit value relative to a maximum value line 66 that shows a maximum value of the brightness V. Accordingly, the signal processing unit 20 can make the limit value line 68 different from a limit value line 69 when the limit proportion value β in the HSV color space is a constant as illustrated in FIG. 6.

In FIGS. 5 and 6, a circle represents an input signal value, and a star represents the input signal value that has been extended. In an example in FIG. 5, an extension coefficient α', by which brightness V(S1') with the saturation value of S1' becomes Vmax (S1') that is a value tangent to the limit value line 68, is defined as the extension coefficient of a corresponding image. In an example in FIG. 6, an extension coefficient α, by which brightness V(S1) with the saturation value of S1 becomes Vmax (S1) that is a value tangent to the limit value line 69, is defined as the extension coefficient of the corresponding image.

The signal processing unit 20 sets the limit proportion value β to different values according to the spaces, and therefore can extend a signal more appropriately. For example, a limit proportion value for a space that exerts a large influence on the display quality is made small, and a limit proportion value for a space that exerts a small influence on the display quality is made large, and therefore an extension coefficient can be increased while maintaining the display quality. For example, as described in the embodiment, a limit proportion value for a space where S is close to 1 (0.8≤S in the embodiment) is smaller than a limit proportion value for a space where S is relatively lower (S<0.8), and accordingly it is possible that while the display quality is maintained in a high-saturation region where a color change is noticeable for human eyes, a high extension coefficient is set in other regions. A limit proportion value for a space where S is close to 0 (S≤0.5 in the present embodiment) is smaller than a limit proportion value for a space where S is relatively higher (0.5<S), and accordingly it is possible that while the display quality is maintained in a non-saturation region where a gradation change is noticeable for human eyes, a high extension coefficient is set in other regions.

Next, in the embodiment, the output signal value $X_{4-(p,q)}$ can be obtained based on the product of a $Min_{(p,q)}$ and the extension coefficient α. Specifically, the output signal value $X_{4-(p,q)}$ can be obtained based on the following equation (11).

$$X_{4-(p,q)}=Min_{(p,q)}\cdot\alpha/\chi \tag{11}$$

In the equation (11), the product of the $Min_{(p,q)}$ and the extension coefficient α is divided by χ. However, the present disclosure is not limited thereto. The extension coefficient α is decided for each image display frame.

These points are explained below.

Generally, in the (p,q)th pixel, saturation $S_{(p,q)}$ and brightness $V(S)_{(p,q)}$ in a cylindrical HSV color space can be obtained from the following equations based on the first sub-pixel input signal (the signal value $x_{1-(p,q)}$), the second sub-pixel input signal (the signal value $x_{2-(p,q)}$), and the third sub-pixel input signal (the signal value $x_{3-(p,q)}$).

$$S_{(p,q)}=(Max_{(p,q)}-Min_{(p,q)})/Max_{(p,q)} \tag{12-1}$$

$$V(S)_{(p,q)}=Max_{(p,q)} \tag{12-2}$$

The $Max_{(p,q)}$ is a maximum value of the three sub-pixel input signal values ($x_{1-(p,q)}$, $x_{2-(p,q)}$, and $x_{3-(p,q)}$). The $Min_{(p,q)}$ is a minimum value of the three sub-pixel input signal values ($x_{1-(p,q)}$, $x_{2-(p,q)}$, and $x_{3-(p,q)}$). In the embodiment, n=8. That is, the number of display gradation bits is 8 (256 gradations from the display gradation values ranging from 0 to 255).

No color filter is arranged in the fourth sub-pixel 49W that displays a white color. It is assumed that the luminance of a combination of the first sub-pixel 49R, the second sub-pixel 49G, and the third sub-pixel 49B that constitute a pixel or a pixel group, when a signal with a value corresponding to a maximum signal value of a first sub-pixel output signal is input to the first sub-pixel 49R, when a signal with a value corresponding to a maximum signal value of a second sub-pixel output signal is input to the second sub-pixel 49G, and when a signal with a value corresponding to a maximum signal value of a third sub-pixel output signal is input to the third sub-pixel 49B, is represented as $BN_{1-3}$. It is also assumed that the luminance of the fourth sub-pixel 49W, when a signal with a value corresponding to a maximum signal value of a fourth sub-pixel output signal is input to the fourth sub-pixel 49W that constitutes a pixel or a pixel group, is represented as $BN_4$. That is, a white color with the maximum luminance is displayed by the combination of the first sub-pixel 49R, the second sub-pixel 49G, and the third sub-pixel 49B, and the luminance of the white color is represented as $BN_{1-3}$. Accordingly, when $\chi$ is a constant dependent on a display device, the constant $\chi$ is expressed as $\chi=BN_4/BN_{1-3}$.

Specifically, the luminance $BN_4$ when an input signal with the display gradation value 255 is assumed to be input to the fourth sub-pixel 49W is, for example, one and a half times as high as the luminance $BN_{1-3}$ of the white color when input signals with the following display gradation values, $x_{1-(p,q)}=255$, $x_{2-(p,q)}=255$, and $x_{3-(p,q)}=255$ are input to the combination of the first sub-pixel 49R, the second sub-pixel 49G, and the third sub-pixel 49B, respectively. That is, in the embodiment, $\chi=1.5$.

Meanwhile, when the signal value $X_{4-(p,q)}$ is given by the equation (11) described above, Vmax(S) can be expressed by the following equation.

In a case where $S \leq S_0$:

$$V\max(S)=(\chi+1)\cdot(2^n-1) \tag{13-1}$$

In a case where $S_0<S\leq 1$:

$$V\max(S)=(2^n-1)\cdot(1/S) \tag{13-2}$$

where $S_0=1/(\chi+1)$.

The maximum value Vmax(S) of brightness, where the saturation S in the HSV color space enlarged by adding the fourth color is a variable, is obtained in the manner as described above, and is stored in the signal processing unit 20 as a kind of look-up table, or is obtained by the signal processing unit 20 as needed.

Next, the method of obtaining the output signal values of the (p,q) th pixel, $X_{1-(p,q)}$, $X_{2-(p,q)}$, $X_{3-(p,q)}$, and $X_{4-(p,q)}$ (extension processing), will be explained below. The following processing is performed so as to maintain the proportion of the luminance of the first primary color displayed by (the first sub-pixel 49R+the fourth sub-pixel 49W), the luminance of the second primary color displayed by (the second sub-pixel 49G+the fourth sub-pixel 49W), and the luminance of the third primary color displayed by (the third sub-pixel 49B+the fourth sub-pixel 49W). Moreover, the processing is performed so as to hold (maintain) the color tone. Further, the processing is performed so as to hold (maintain) the gradation-luminance characteristics (gamma characteristics, $\gamma$ characteristics).

In a case where input signal values of any of pixels or of pixel groups are all "0" (or are all small), it suffices that the extension coefficient $\alpha$ is obtained without including such a pixel or such a pixel group.

[Step-100]

First, based on input signal values of sub-pixels in plural pixels, the signal processing unit 20 obtains the saturation S and the brightness V(S) of these pixels. Specifically, $S_{(p,q)}$ and $V(S)_{(p,q)}$ are obtained from the equations (12-1) and (12-2), respectively, based on the first sub-pixel input signal value $x_{1-(p,q)}$, the second sub-pixel input signal value $x_{2-(p,q)}$, and the third sub-pixel input signal value $x_{3-(p,q)}$ to the (p,q)th pixel. This processing is performed on all the pixels.

[Step-110]

Next, the signal processing unit 20 obtains an extension coefficient $\alpha(S)$ based on the Vmax(S)/V(S) obtained for plural pixels.

$$\alpha(S)=V\max(S)/V(S) \tag{14}$$

Values of the extension coefficients $\alpha(S)$ obtained for plural pixels (for all pixels in the embodiment, where the number of the pixels is $P_0\times Q_0$) are sorted in ascending order. Among the values of the extension coefficients $\alpha(S)$, where the number of these values is $P_0\times Q_0$, a value of an extension coefficient $\alpha(S)$ which corresponds to the $\beta\times P_0\times Q_0$-th smallest extension coefficient $\alpha(S)$ from a minimum value of the sorted extension coefficients $\alpha(S)$ is defined as the extension coefficient $\alpha$. In this manner, the extension coefficient $\alpha$ can be decided such that the proportion of pixels, in which the value of the extended brightness, obtained from the product of the brightness V(S) and the extension coefficient $\alpha$, exceeds the maximum value Vmax(S), relative to all the pixels, is equal to or lower than a predetermined value ($\beta$).

In the embodiment, the limit proportion value $\beta$ is preferably equal to or larger than 0 and equal to or smaller than 0.2 (equal to or larger than 0% and equal to or smaller than 20%), more preferably equal to or larger than 0.0001 and equal to or smaller than 0.20 (equal to or larger than 0.01% and equal to or smaller than 20%), and even more preferably equal to or larger than 0.003 and equal to or smaller than 0.05 (equal to or larger than 0.3% and equal to or smaller than 5%), for example. This $\beta$ value is decided through performing various kinds of tests.

When the minimum value of Vmax(S)/V(S) is used as the extension coefficient $\alpha$, an output signal value relative to an input signal value does not exceed $(2^8-1)$. However, when the extension coefficient $\alpha$ is not the minimum value of Vmax(S)/V(S), but is decided in the manner as described above, the brightness for a pixel, in which the extension coefficient $\alpha(S)$ is smaller than the extension coefficient $\alpha$, is multiplied by the extension coefficient $\alpha$, and the value of the extended brightness exceeds the maximum value Vmax(S). As a result, so-called "gradation loss" occurs. However, the $\beta$ value is, for example, between 0.003 and 0.05 as described above, and therefore the occurrence of a phenomenon in which gradation loss is noticeable and an image looks unnatural is able to be prevented. On the other hand, when the $\beta$ value exceeded 0.05, an unnatural image with noticeable gradation loss is confirmed in some cases. When an output signal value exceeds $(2^n-1)$ that is a limit value through the extension processing, it suffices that the output signal value is set to $(2^n-1)$ that is the limit value.

Normally, values of the extension coefficient $\alpha(S)$ exceed 1.0, and often gather near 1.0. Therefore, when the minimum value of Vmax(S)/V(S) is used as the extension coefficient $\alpha$, the output signal value is extended to a small degree, and it is often difficult to achieve low power consumption in a display device. Accordingly, the $\beta$ value is set equal to or larger than 0 and equal to or smaller than 0.2, for example, and consequently the value of the extension coefficient $\alpha$ in at least a part of a space can be made large. It suffices that the luminance of the planar light-source device 50 is multiplied by a factor of $(1/\alpha)$ as described later, and thus it is possible to achieve low power consumption in a display device.

[Step-120]

Next, the signal processing unit 20 obtains the signal value $X_{4-(p,q)}$ of the (p,q)th pixel based on at least the signal value $x_{1-(p,q)}$, the signal value $x_{2-(p,q)}$, and the signal value $x_{3-(p,q)}$. Specifically, in the present embodiment, the signal value $X_{4-(p,q)}$ is decided based on the $Min_{(p,q)}$, the extension coefficient $\alpha$, and the constant $\chi$. More specifically, in the embodiment, the signal value $X_{4-(p,q)}$ is obtained based on the following equation (11) as described above.

$$X_{4-(p,q)}=\mathrm{Min}_{(p,q)}\cdot\alpha/\chi \tag{11}$$

$X_{4-(p,q)}$ is obtained for all pixels, where the number of the pixels is $P_0\times Q_0$.

[Step-130]

Thereafter, the signal processing unit 20 obtains the signal value $X_{1-(p,q)}$ of the (p,q)th pixel based on the signal value $x_{1-(p,q)}$, the extension coefficient α, and the signal value $X_{4-(p,q)}$, also obtains the signal value $X_{2-(p,q)}$ of the (p,q)th pixel based on the signal value $x_{2-(p,q)}$, the extension coefficient α, and the signal value $X_{4-(p,q)}$, and also obtains the signal value $X_{3-(p,q)}$ of the (p,q)th pixel based on the signal value $x_{3-(p,q)}$, the extension coefficient α, and the signal value $X_{4-(p,q)}$. Specifically, the signal value $X_{1-(p,q)}$, the signal value $X_{2-(p,q)}$, and the signal value $X_{3-(p,q)}$ of the (p,q)th pixel are obtained based on the following equations as described above.

$$X_{1-(p,q)}=\alpha\cdot x_{1-(p,q)}-\chi\cdot X_{4-(p,q)}$$

$$X_{2-(p,q)}=\alpha\cdot x_{2-(p,q)}-\chi\cdot X_{4-(p,q)}$$

$$X_{3-(p,q)}=\alpha\cdot x_{3-(p,q)}-\chi\cdot X_{4-(p,q)}$$

As expressed by the equation (11), the signal processing unit 20 extends the value of $Min_{(p,q)}$ by α. As described above, the value of $Min_{(p,q)}$ is extended by α, and therefore not only the luminance of a white display sub-pixel (the fourth sub-pixel 49W) increases, but also the luminance of a red display sub-pixel, a green display sub-pixel, and a blue display sub-pixel (the first sub-pixel 49R, the second sub-pixel 49G, and the third sub-pixel 49B) increases, as expressed by the above equations. Accordingly, the occurrence of problems such as causing dullness of colors can be reliably avoided. That is, because the value of $Min_{(p,q)}$ is extended by α, the luminance of the entire image is α times as high as that in the case where the value of $Min_{(p,q)}$ is not extended. Therefore, an image such as a still image can be displayed with high luminance, which is most appropriate.

In the display device according to the embodiment, the signal value $X_{1-(p,q)}$, the signal value $X_{2-(p,q)}$, the signal value $X_{3-(p,q)}$, and the signal value $X_{4-(p,q)}$ of the (p,q)th pixel are extended by a factor of α. Therefore, it suffices that the luminance of the planar light-source device 50 is decreased based on the extension coefficient α in order to have the same image luminance as the luminance of an unextended image. Specifically, it suffices that the luminance of the planar light-source device 50 is multiplied by a factor of (1/α). Accordingly, reduction in power consumption in the planar light-source device 50 can be achieved. The signal processing unit 20 outputs this (1/α) to the filter 80 (see FIG. 1) as a control signal.

As described above, by dividing an HSV color space into plural spaces, and setting the limit proportion value β for each of the divided spaces, the display device according to the embodiment can set an extension coefficient to a value at which power consumption can be reduced while maintaining the display quality.

In the above embodiment, the HSV color space is divided based on hue and saturation as references, that is, respective threshold values of hue and saturation are set to divide the HSV color space into spaces using the threshold values as boundaries. However, the present disclosure is not limited thereto. It suffices that the signal processing unit 20 divides the HSV color space based on at least one of hue, saturation, and brightness as a reference, as described above. Therefore, the HSV color space can also be divided based on one of three parameters that are hue, saturation, and brightness as a reference, or the HSV color space can also be divided based on two of the three parameters as references, or the HSV color space can also be divided based on all the three parameters as references.

Figure 7:
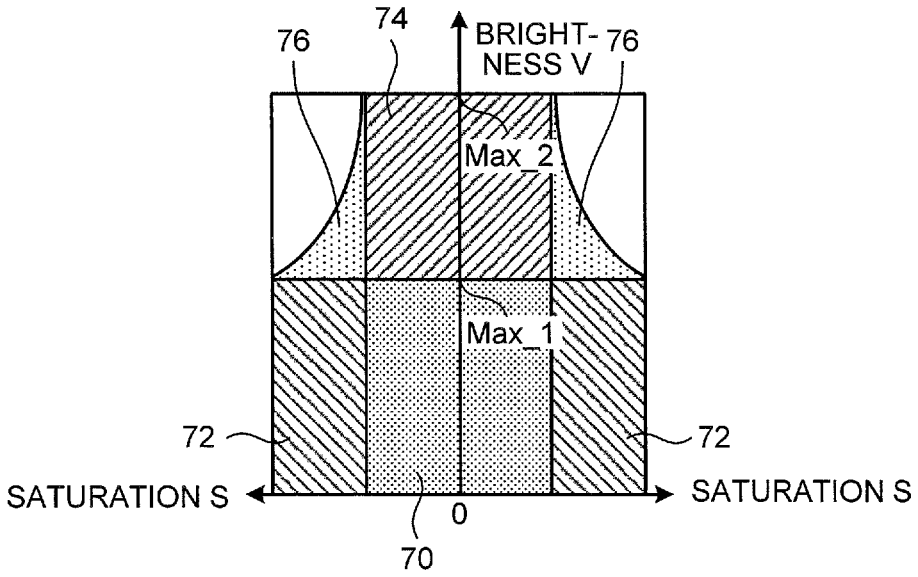
FIG. 7 is a conceptual diagram illustrating a relationship between saturation and brightness in an extended HSV color space.
Figure 8:
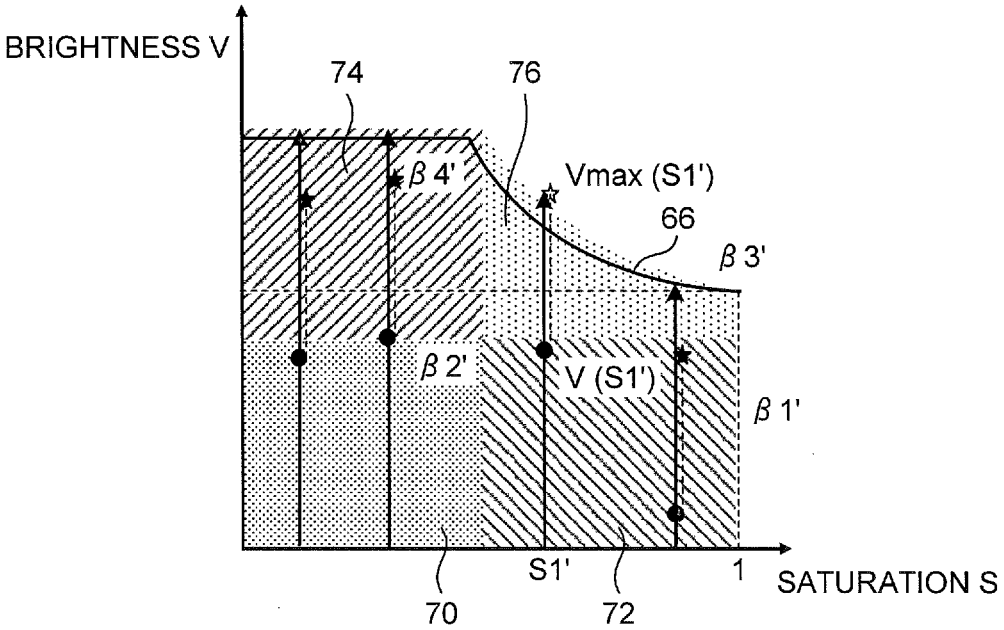
FIG. 8 is a conceptual diagram illustrating a relationship between saturation and brightness in an extended HSV color space.

An example in which an HSV color space (an extended HSV color space) is divided will be explained below with reference to FIGS. 7 and 8. FIG. 7 is a conceptual diagram illustrating a relationship between saturation and brightness in the extended HSV color space. FIG. 8 is a conceptual diagram illustrating a relationship between saturation and brightness in the extended HSV color space. In an example illustrated in FIGS. 7 and 8, a limit proportion value β1' in a space 72, where the hue H is included within 0≤H<360, the saturation S is included within 0.5≤S, and the brightness V is included within $0\le V\le Max_1$, is set to 0.01 (1%). Also, a limit proportion value β2' in a space 70, where the hue H is included within 0≤H<360, the saturation S is included within S<0.5, and the brightness V is included within $0\le V\le Max_1$, is set to 0.01 (1%). Also, a limit proportion value β3' in a space 76, where the hue H is included within 0≤H<360, the saturation S is included within 0.5≤S, and the brightness V is included within Max_1<V≤Max_2, is set to 0.03 (3%). Also, a limit proportion value β4' in a space 74, where the hue H is included within 0≤H<360, the saturation S is included within S<0.5, and the brightness V is included within Max_1<V≤Max_2, is set to 0.03 (3%).

That is, in the example illustrated in FIGS. 7 and 8, the limit proportion value β in a case where the brightness V is included within $0\le V\le Max_1$ is different from the limit proportion value β in a case where the brightness V is not included within $0\le V\le Max_1$ (that is, Max_1<V≤Max_2). Therefore, as illustrated in FIGS. 7 and 8, the space 70 where S≤0.5 and $0\le V\le Max_1$ and the space 72 where 0.5<S and $0\le V\le Max_1$ have a relationship with a limit value line that shows a limit value relative to the maximum value line 66 that shows a maximum value of the brightness V, different from the space 74 where S≤0.5 and Max_1<V≤Max_2 and the space 76 where 0.5<S and Max_1<V≤Max_2.

It suffices that the display device 10 divides the extended HSV color space into plural spaces, and sets different limit proportion values for each of at least two spaces of the divided spaces. In a part of the extended HSV color space, a space where a limit proportion value is not set, that is, a space that is not an analysis target at the time of calculating an extension coefficient, can also be provided. The display device 10 can set a limit proportion value appropriate to each of restriction-target spaces, and therefore can obtain the advantages described above, although a limit proportion value is not set for a part of the space.

The display device 10 can also include plural pieces of data that shows a rule for dividing the extended HSV color space into plural spaces and information regarding a limit proportion value set for each of the divided spaces, and change the data that is used. For example, the display device 10 can also change the rule that is used for dividing the extended HSV color space into plural spaces, and change the information regarding the limit proportion value set for each of the divided spaces, depending on whether a displayed image is a moving image or a still image. The display device 10 can also change the data that is used according to the usage environment (indoor or outdoor, and in light or dark).

In the above descriptions, the display device 10 divides the extended HSV color space. However, it suffices that the display device 10 does not divide the extended HSV color space.

Filter Configuration

Figure 9:
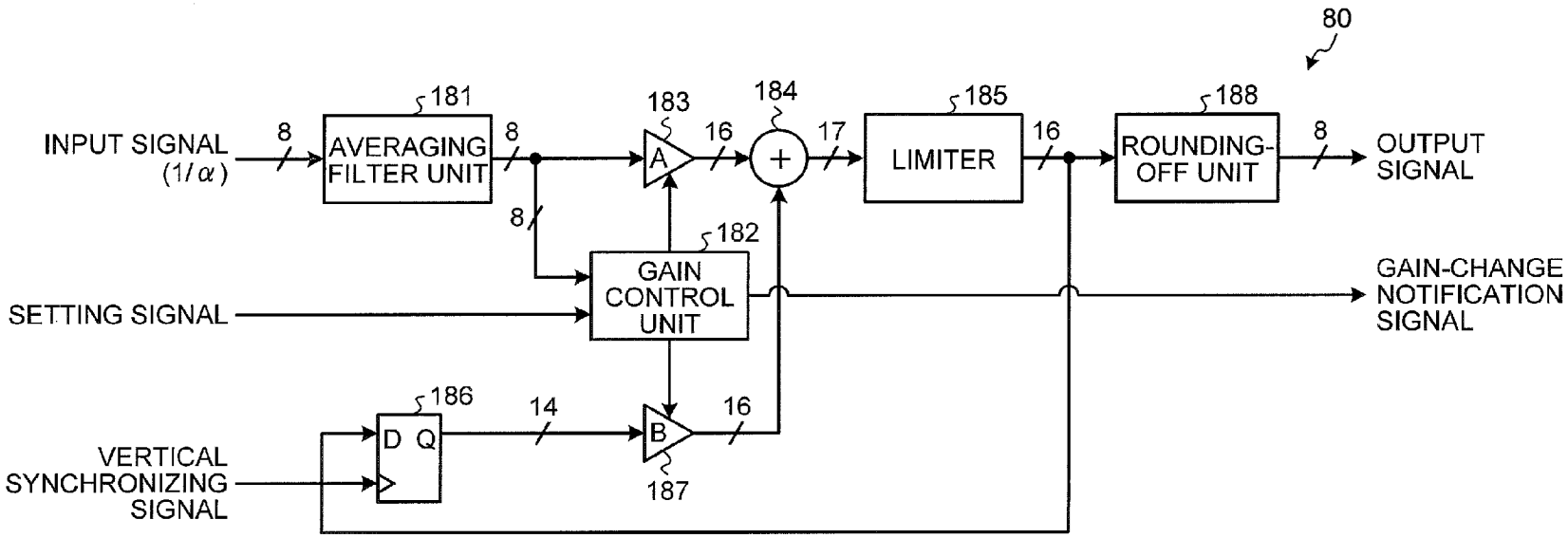
FIG. 9 is a block diagram of a configuration example of a filter illustrated in FIG. 1.

FIG. 9 is a block diagram of a configuration example of a filter (signal processing circuit) illustrated in FIG. 1. As illustrated in FIG. 9, the filter 80 includes an averaging filter unit 181, a gain control unit 182, a multiplier 183, an adder 184, a limiter 185, a flip-flop 186, a multiplier 187, and a rounding-off unit 188.

The averaging filter unit 181 outputs an 8-bit width signal, obtained by performing a moving-average of an 8-bit width control signal (an input signal) ($1/\alpha$) that is input from the signal processing unit 20, to the gain control unit 182 and the multiplier 183. The averaging filter unit 181 is intended to reduce noise of the input signal ($1/\alpha$) and its fluctuations, and can be omitted.

The gain control unit 182 sets a gain A of the multiplier 183 and a gain B of the multiplier 187 based on the averaged input signal ($1/\alpha$) that is input from the averaging filter unit 181 (hereinafter, also simply "input signal ($1/\alpha$)"). The configuration of the gain control unit 182 is described later.

The multiplier 183 multiplies the 8-bit width signal that is input from the averaging filter unit 181 by the gain A that is set by the gain control unit 182 to output a 16-bit width signal to the adder 184.

The adder 184 adds the 16-bit width signal that is input from the multiplier 183 and a 16-bit width signal that is input from the multiplier 187 together to output a 17-bit width signal to the limiter 185.

When there is a carry in the MSB (most significant bit) of the 17-bit width signal that is input from the adder 184, the limiter 185 restricts the 17-bit width signal to a maximum value that can be represented by a 16-bit width, that is, to 0xFFFF, and outputs a 16-bit width signal to the flip-flop 186 and the rounding-off unit 188.

In the flip-flop 186, a vertical synchronizing signal is input to its clock input terminal. In synchronization with the vertical synchronizing signal, the flip-flop 186 latches the 14 higher-order bits of the 16-bit width signal that is input from the limiter 185, and outputs a 14-bit width signal to the multiplier 187. That is, the flip-flop 186 delays a signal of the previous frame, which is input from the limiter 185, by one frame time to output the signal to the multiplier 187.

The multiplier 187 multiplies the 14-bit width signal that is input from the flip-flop 186 by the gain B that is set by the gain control unit 182 to output a 16-bit width signal to the adder 184.

The rounding-off unit 188 outputs an 8-bit width signal, obtained by rounding off the 8 lower-order bits of the 16-bit width signal that is input from the limiter 185 to the 8 higher-order bits, to the planar light-source device control circuit 60 (see FIG. 1) as an output signal (a planar light-source device control signal). The rounding-off unit 188 is intended to match the bit width (a 16-bit width in this example) output from the limiter 185 and the bit width (an 8-bit width in this example) input to the planar light-source device control circuit 60 to each other. In a case where the bit width output from the limiter 185 corresponds with the bit width input to the planar light-source device control circuit 60, the rounding-off unit 188 can be omitted.

In this manner, the multiplier 183, the adder 184, the flip-flop 186, and the multiplier 187 constitute an IIR (infinite impulse response) filter.

Figure 10:
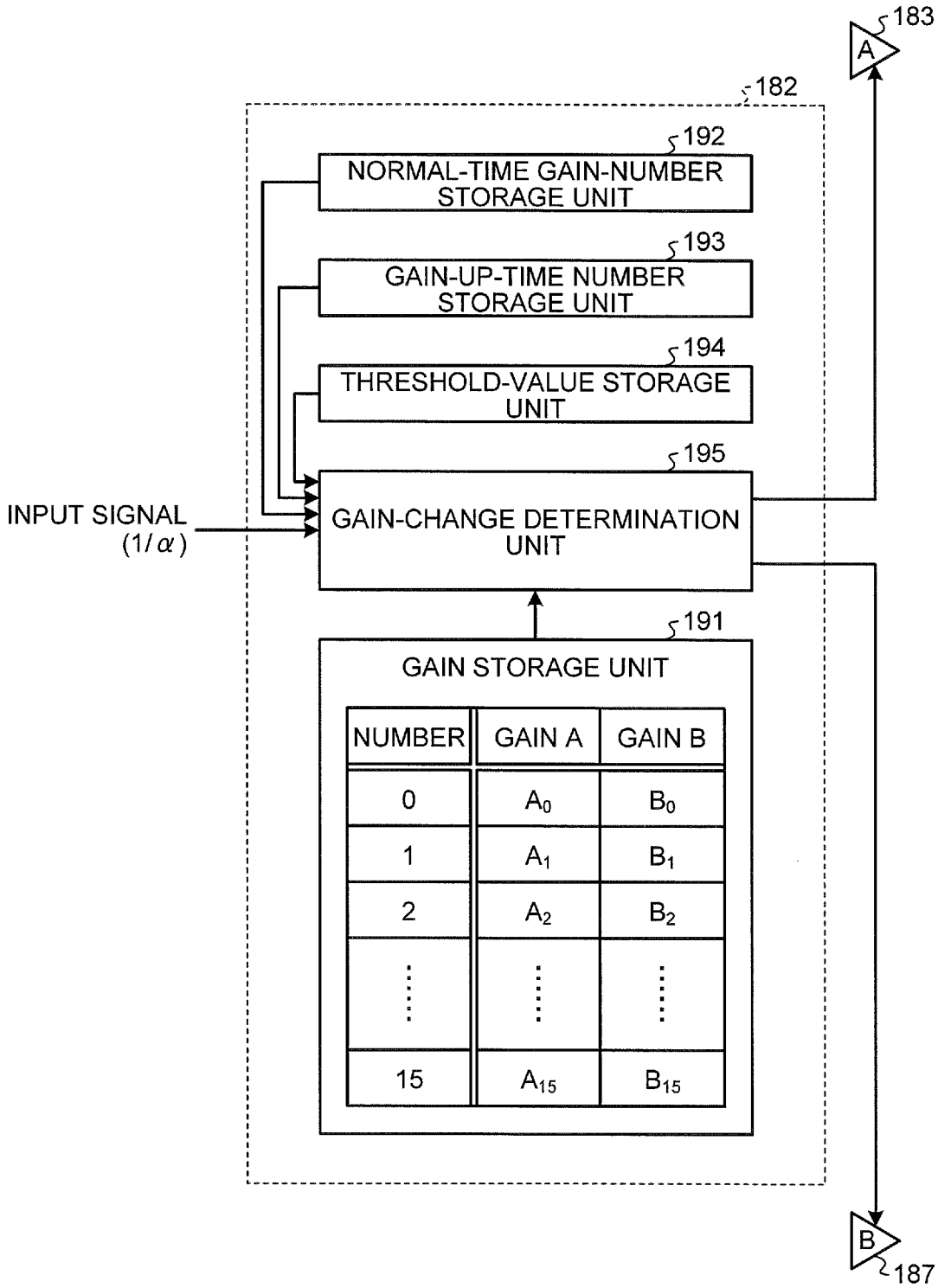
FIG. 10 is a block diagram of a configuration example of a gain control unit illustrated in FIG. 9.

FIG. 10 is a block diagram of a configuration example of a gain control unit illustrated in FIG. 9. As illustrated in FIG. 10, the gain control unit 182 includes a gain storage unit 191, a normal-time gain-number storage unit 192, a gain-up-time number storage unit 193, a threshold-value storage unit 194, and a gain-change determination unit 195.

The gain storage unit 191 stores therein a set (total 16 sets) of a gain $A_n$ and a gain $B_n$ (where n is an integer of $0 \le n \le 15$) in association with a number from 0 to 15. The gain storage unit 191 can be a non-rewritable and non-volatile memory such as a ROM (read only memory), or can be a rewritable and non-volatile memory such as a flash memory.

In a case where the gain storage unit 191 is a non-rewritable and non-volatile memory, the display-device manufacturer's recommended values of the gain $A_n$ and the gain $B_n$ are written thereto at the time of manufacturing the display device 10 (more specifically, at the time of manufacturing the non-rewritable and non-volatile memory), and the display device 10 is shipped to an electronic-apparatus manufacturer. Therefore, the filter 80 can use the display-device manufacturer's recommended values easily.

In a case where the gain storage unit 191 is a rewritable and non-volatile memory, the gain $A_n$ and the gain $B_n$ can be written thereto at the time of manufacturing the display device 10, or can be written thereto at the time of manufacturing an electronic apparatus at the site of an electronic-apparatus manufacturer after having shipped the display device 10 to the electronic-apparatus manufacturer. Alternatively, the display-device manufacturer's recommended values can be written thereto at the time of manufacturing the display device 10, and then be modified by the electronic-apparatus manufacturer. Therefore, the filter 80 can use the display-device manufacturer's recommended values that can be easily adjusted.

The gain storage unit 191 can also be a volatile memory such as a RAM (random access memory). In a case where the gain storage unit 191 is a volatile memory, the gain $A_n$ and the gain $B_n$ are written thereto from a host CPU (not illustrated) at the time of booting an electronic apparatus having the display device 10 incorporated therein. Therefore, the filter 80 can flexibly use a gain according to the usage conditions of the electronic apparatus.

The filter 80 is the IIR filter in which there is a relationship expressed as $A_n+B_n=1$. Therefore, the gain storage unit 191 can store therein one of the gain $A_n$ and the gain $B_n$, and calculate the other from the above equation.

In this example, the gain storage unit 191 stores therein 16 sets of the gain $A_n$ and the gain $B_n$. However, the present disclosure is not limited thereto. For example, the gain storage unit 191 can also store therein four sets, eight sets, 32 sets, or 64 sets of the gain $A_n$ and the gain $B_n$.

When an input signal ($1/\alpha$) is smaller than a threshold value described later (hereinafter, sometimes "at normal time"), the normal-time gain-number storage unit (corresponding to a first information storage unit of the present disclosure) 192 stores therein the number i (where is an integer of $0 \le i \le 15$), that is, first information regarding which of 16 sets of gains stored in the gain storage unit 191 is selected. The normal-time gain-number storage unit 192 can be a volatile memory such as a RAM. The normal-time gain-number storage unit 192 can be a rewritable and non-volatile memory such as a flash memory. Therefore, the number i, which has been written once, can be used again at the time of next power-on, and accordingly rewriting of the number i is unnecessary. A gain $A_i$ corresponds to a first gain of the present disclosure. A gain $B_i$ corresponds to a second gain of the present disclosure.

The normal-time gain-number storage unit 192 can also store therein an address of the gain $A_i$ and the gain $B_i$ in the gain storage unit 191 as the first information, instead of the number i.

When the input signal ($1/\alpha$) is equal to or larger than the threshold value described later (hereinafter, sometimes "at the gain-up time"), the gain-up-time number storage unit (corresponding to a second information storage unit of the present disclosure) 193 stores therein the number j (where j is an integer of $0 \le j \le 15$), that is, second information regarding which of 16 sets of gains stored in the gain storage unit 191 is selected. The gain-up-time number storage unit 193 can be a volatile memory such as a RAM. The gain-up-time number storage unit 193 can be a rewritable and non-volatile memory such as a flash memory. Therefore, the number j, which has been written once, can be used again at the time of next power-on, and accordingly rewriting of the number j is unnecessary. A gain $A_j$ corresponds to a third gain of the present disclosure. A gain $B_j$ corresponds to a fourth gain of the present disclosure.

The gain-up-time number storage unit 193 can also store therein an address of the gain $A_j$ and the gain $B_j$ in the gain storage unit 191 as the second information, instead of the number j.

The threshold-value storage unit 194 stores therein a threshold value Th that is a determination criterion used in setting the gain A of the multiplier 183 and the gain B of the multiplier 187. The threshold-value storage unit 194 can be a volatile memory such as a RAM. The threshold-value storage unit 194 can be a rewritable and non-volatile memory such as a flash memory. Therefore, a threshold value, which has been written once, can be used again at the time of next power-on, and accordingly rewriting of the threshold value is unnecessary.

As explained above, values of the extension coefficient $\alpha$ normally exceed 1.0, and often gather near 1.0. Therefore, it is considered to be preferable to set a threshold value approximately to 0.98 or 0.99. The threshold value Th is assumed to be 0.98 in the following explanations.

The gain-change determination unit 195 compares the input signal $(1/\alpha)$ with the threshold value Th stored in the threshold-value storage unit 194. When the input signal $(1/\alpha)$ is smaller than the threshold value Th, that is, at the normal time, the gain-change determination unit 195 reads the gain $A_i$ and the gain $B_i$, associated with the number i stored in the normal-time gain-number storage unit 192, from the gain storage unit 191. The gain-change determination unit 195 sets the read gain $A_i$, that is, the first gain, as the gain A of the multiplier 183, and sets the read gain $B_i$, that is, the second gain, as the gain B of the multiplier 187.

The gain-change determination unit 195 compares the input signal $(1/\alpha)$ with the threshold value Th stored in the threshold-value storage unit 194. When the input signal $(1/\alpha)$ is equal to or larger than the threshold value Th, that is, at the gain-up time, the gain-change determination unit 195 reads the gain $A_j$ and the gain $B_j$, associated with the number j stored in the gain-up-time number storage unit 193, from the gain storage unit 191. the gain-change determination unit 195 sets the read gain $A_j$, that is, the third gain, as the gain A of the multiplier 183, and sets the read gain $B_j$, that is, the fourth gain, as the gain B of the multiplier 187.

When the gain $A_i$ or the gain $A_j$ is equal to the gain A that is currently set in the multiplier 183, the gain-change determination unit 195 does not have to set the gain $A_i$ or the gain $A_j$ in the multiplier 183. Similarly, when the gain $B_i$ or the gain $B_j$ is equal to the gain B that is currently set in the multiplier 187, the gain-change determination unit 195 does not have to set the gain $B_i$ or the gain $B_j$ in the multiplier 187.

Upon setting the gain A and the gain B, the gain-change determination unit 195 outputs a gain-change notification signal (see FIG. 9).

Setting the gain A in the multiplier 183 and setting the gain B in the multiplier 187 is equivalent to setting a time constant in the filter 80.

Figure 11:
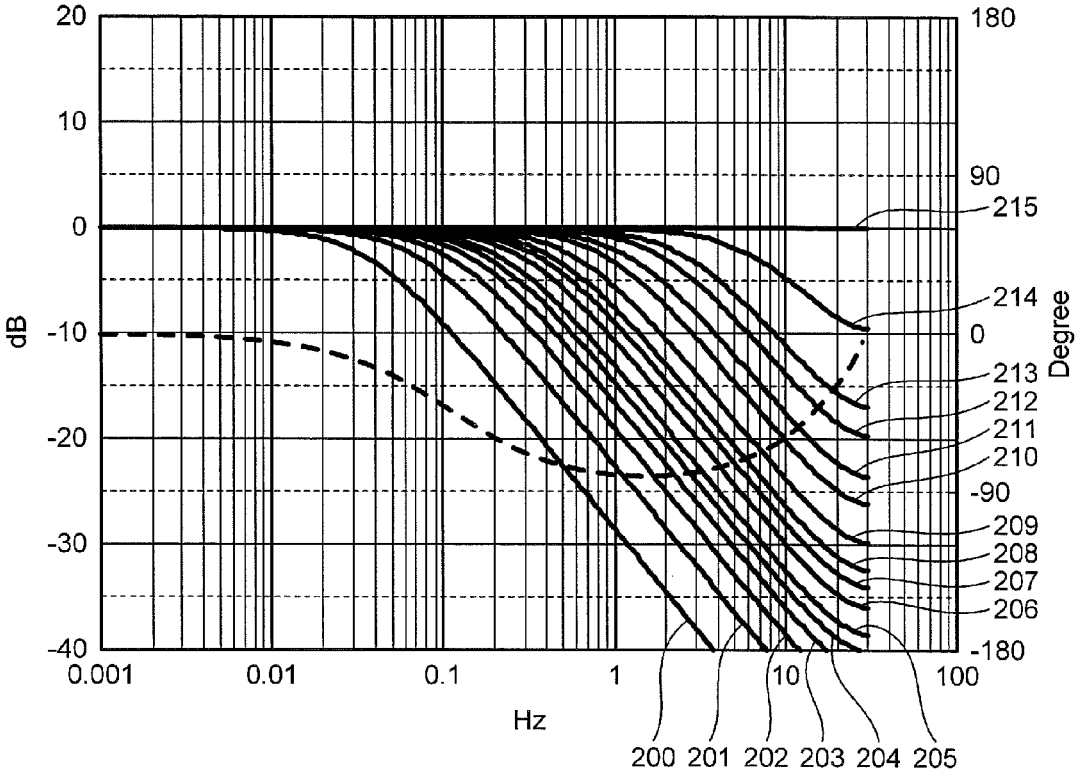
FIG. 11 illustrates an example of frequency characteristics of the filter.

FIG. 11 illustrates an example of frequency characteristics of the filter. FIG. 11 illustrates 16 different gain characteristics 200 to 215 realized by the 16 sets of the gain $A_n$ and the gain $B_n$ of the number from 0 to 15, and illustrates phase characteristics realized by a gain $A_2$ and a gain $B_2$ of the number 2. FIG. 11 illustrates an example in which as the number increases from 0 to 15, the cut-off frequency becomes higher and the time constant becomes shorter. The gain characteristics 215 realized by a gain $A_{15}$ and a gain $B_{15}$ of the number 15 show that an input signal remains unchanged and is output as an output signal. That is, the gain $A_{15}$ of the number 15 is 1, and the gain $B_{15}$ of the number 15 is 0.

Figure 12:
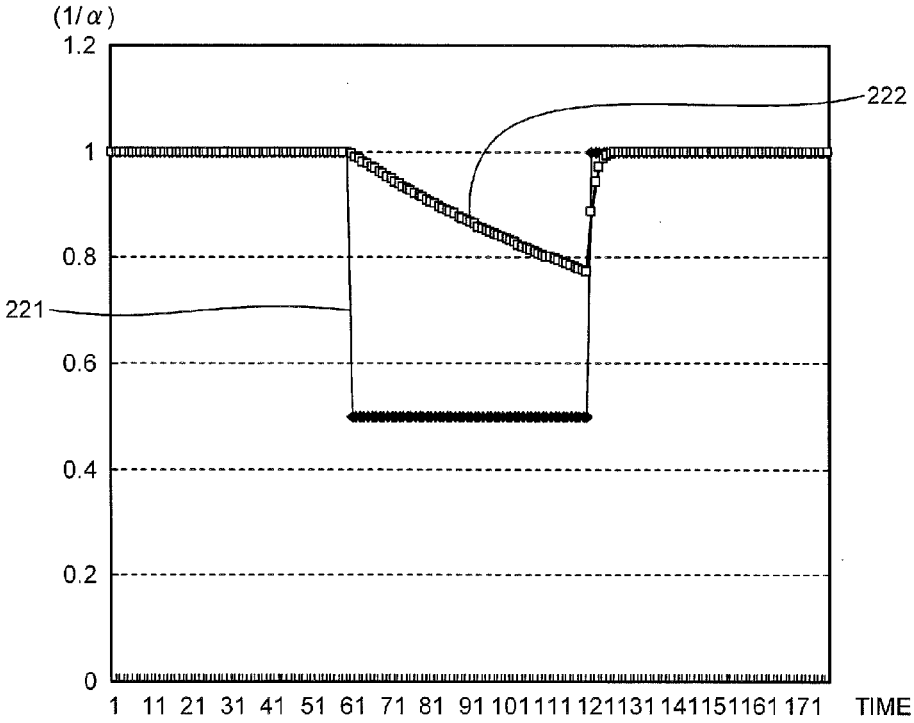
FIG. 12 illustrates a waveform example of an input signal and an output signal of the filter.

FIG. 12 illustrates a waveform example of an input signal and an output signal of the filter. At the normal time, the gain A=1/64 and the gain B=63/64, which corresponds to the gain characteristics 202 (the number 2) in FIG. 11. At the gain-up time, the gain A=1/2 and the gain B=1/2. As illustrated in FIG. 12, when an input signal $(1/\alpha)$ 221 decreases approximately from 1 to 0.5 in a step-like manner, the input signal $(1/\alpha)$ 221 is equal to or smaller than the threshold value 0.98. Therefore, the gain-change determination unit 195 sets the gain A=1/64 at the normal time in the multiplier 183, and sets the gain B=63/64 at the normal time in the multiplier 187. In this case, because the cut-off frequency is very low and the time constant is very long, an output signal 222 decreases approximately from 1 to 0.8 very slowly. Thereafter, when the input signal $(1/\alpha)$ 221 increases approximately from 0.5 to 1 in a step-like manner, the input signal $(1/\alpha)$ 221 is larger than the threshold value 0.98. Therefore, the gain-change determination unit 195 sets the gain A=1/2 at the gain-up time in the multiplier 183, and sets the gain B=1/2 at the gain-up time in the multiplier 187. In this case, because the cut-off frequency is very high and the time constant is very short, the output signal 222 increases approximately from 0.8 to 1 rapidly.

Figure 13:
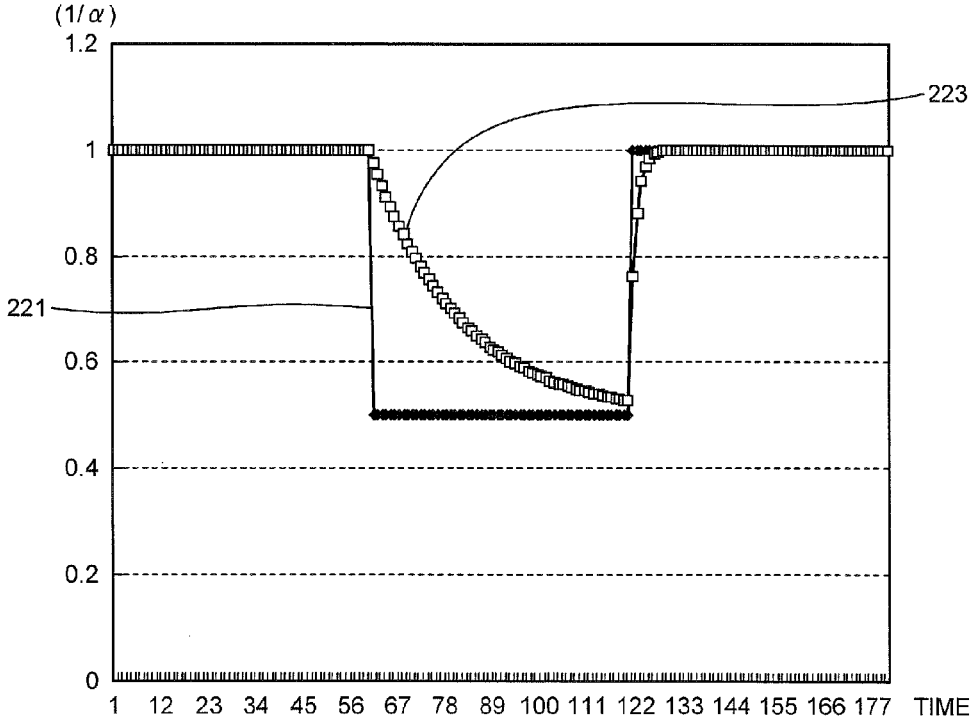
FIG. 13 illustrates a waveform example of an input signal and an output signal of the filter.

FIG. 13 illustrates a waveform example of an input signal and an output signal of the filter. At the normal time, the gain A=3/64 and the gain B=61/64, which corresponds to the gain characteristics 208 (the number 8) in FIG. 11. At the gain-up time, the gain A=1/2 and the gain B=1/2. As illustrated in FIG. 13, when the input signal $(1/\alpha)$ 221 decreases approximately from 1 to 0.5 in a step-like manner, the input signal $(1/\alpha)$ 221 is equal to or smaller than the threshold value 0.98. Therefore, the gain-change determination unit 195 sets the gain A=3/64 at the normal time in the multiplier 183, and sets the gain B=61/64 at the normal time in the multiplier 187. In this case, because the cut-off frequency is moderate and the time constant is moderate, an output signal 223 decreases approximately from 1 to 0.55 smoothly. Thereafter, when the input signal $(1/\alpha)$ 221 increases approximately from 0.5 to 1 in a step-like manner, the input signal $(1/\alpha)$ 221 is larger than the threshold value 0.98. Therefore, the gain-change determination unit 195 sets the gain A=1/2 at the gain-up time in the multiplier 183, and sets the gain B=1/2 at the gain-up time in the multiplier 187. In this case, because the cut-off frequency is very high and the time constant is very short, the output signal 223 increases approximately from 0.55 to 1 rapidly.

Figure 14:
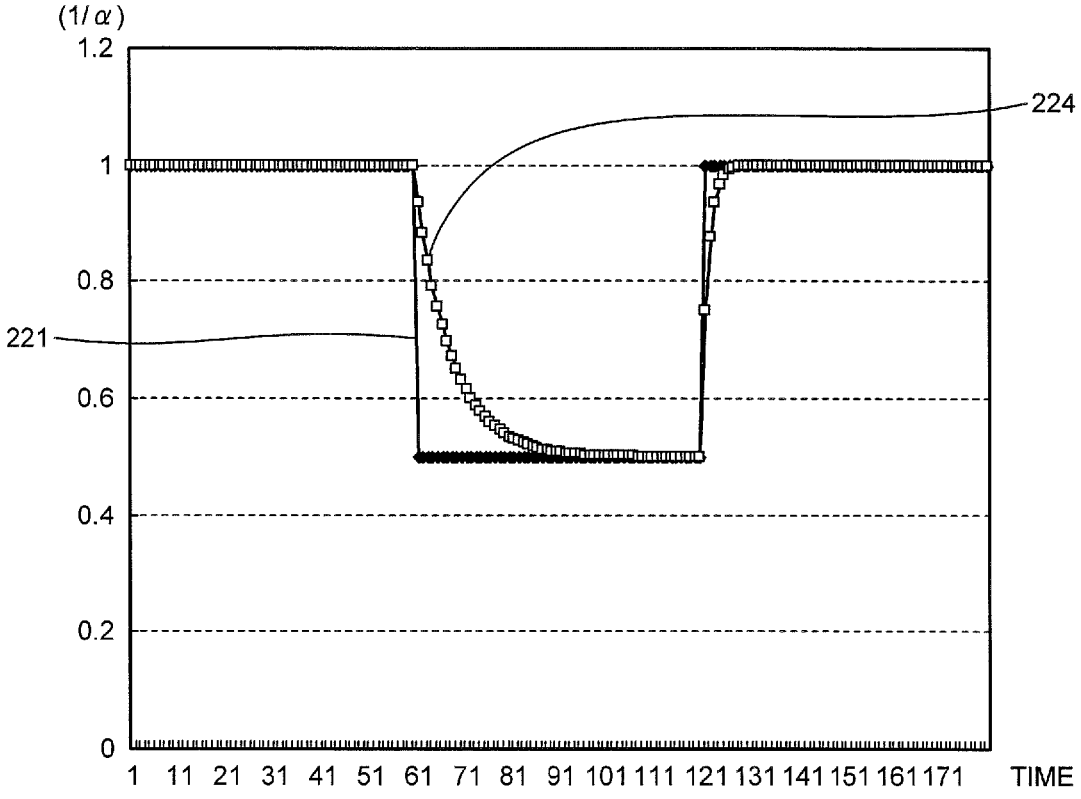
FIG. 14 illustrates a waveform example of an input signal and an output signal of the filter.

FIG. 14 illustrates a waveform example of an input signal and an output signal of the filter. At the normal time, the gain A=1/8 and the gain B=7/8, which corresponds to the gain characteristics 211 (the number 11) in FIG. 11. At the gain-up time, the gain A=1/2 and the gain B=1/2. As illustrated in FIG. 14, when the input signal $(1/\alpha)$ 221 decreases approximately from 1 to 0.5 in a step-like manner, the input signal $(1/\alpha)$ 221 is equal to or smaller than the threshold value 0.98. Therefore, the gain-change determination unit 195 sets the gain A=1/8 at the normal time in the multiplier 183, and sets the gain B=7/8 at the normal time in the multiplier 187. In this case, because the cut-off frequency is high and the time constant is short, an output signal 224 decreases approximately from 1 to 0.5 quickly. Thereafter, when the input signal $(1/\alpha)$ 221 increases approximately from 0.5 to 1 in a step-like manner, the input signal $(1/\alpha)$ 221 is larger than the threshold value 0.98. Therefore, the gain-change determination unit 195 sets the gain A=1/2 at the gain-up time in the multiplier 183, and sets the gain B=1/2 at the gain-up time in the multiplier 187. In this case, because the cut-off frequency is very high and the time constant is very short, the output signal 224 increases approximately from 0.5 to 1 rapidly.

As described above, when the input signal (1/α) is equal to or smaller than the threshold value, the time constant is made long to change the output signal moderately, and when the input signal (1/α) is larger than the threshold value, the time constant is made short to change the output signal rapidly, due to the following reasons.

That is, the status that the input signal (1/α) becomes small indicates that the luminance of the planar light-source device 50 becomes low. There is a case where the luminance of the planar light-source device 50 becomes low rapidly, and then an image viewer can recognize a change in the image. Therefore, when the input signal (1/α) is equal to or smaller than the threshold value, the time constant is made long to change the output signal moderately in order to decrease the luminance of the planar light-source device 50 moderately. Accordingly, an image viewer can be prevented from recognizing a change in the image.

The status that the input signal (1/α) becomes large indicates that the luminance of the planar light-source device 50 becomes high. There is a case where the luminance of the planar light-source device 50 becomes high slowly, and then an image viewer can recognize a change in a part of the colors, particularly a change in a high-saturation color. Therefore, when the input signal (1/α) is larger than the threshold value, the time constant is made short to change the output signal rapidly in order to increase the luminance of the planar light-source device 50 rapidly. Accordingly, an image viewer can be prevented from recognizing a change in a part of the colors.

Control Operation of Display Device

Figure 15:
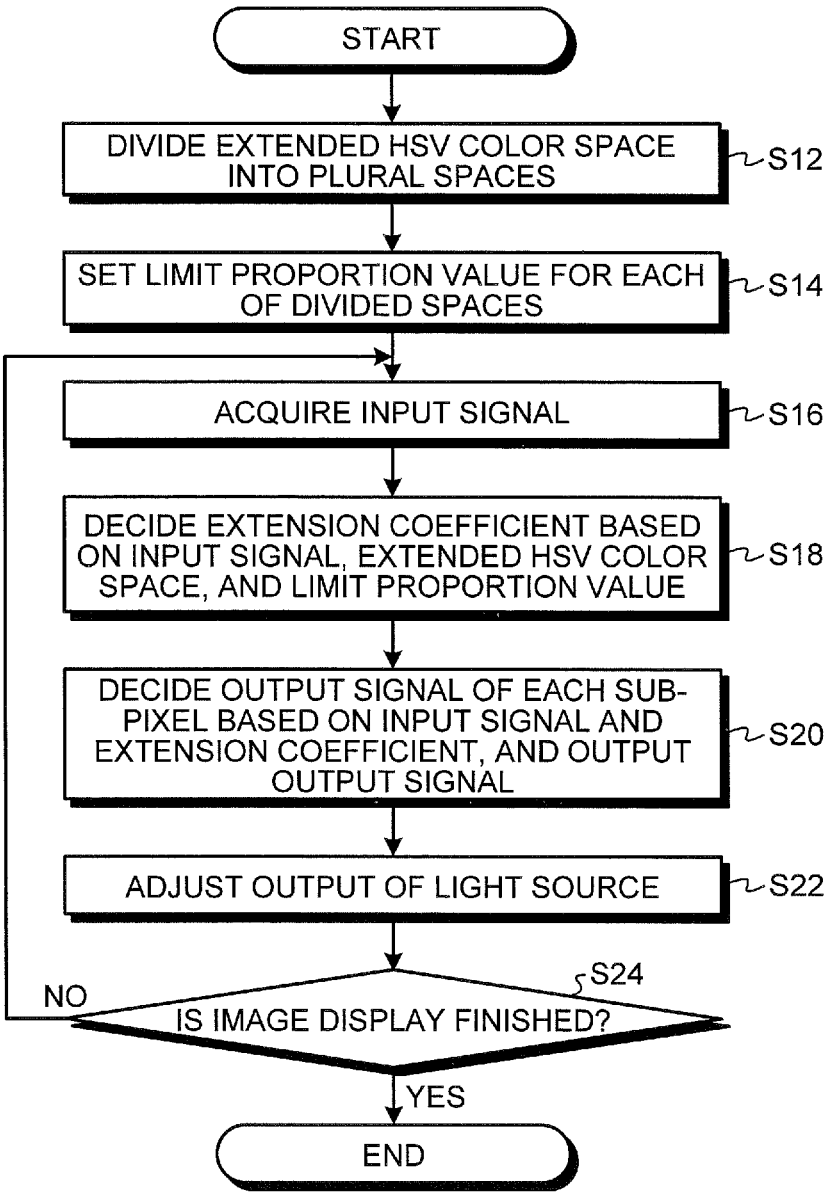
FIG. 15 is a flowchart illustrating an example of a control operation of the display device.
Figure 16:
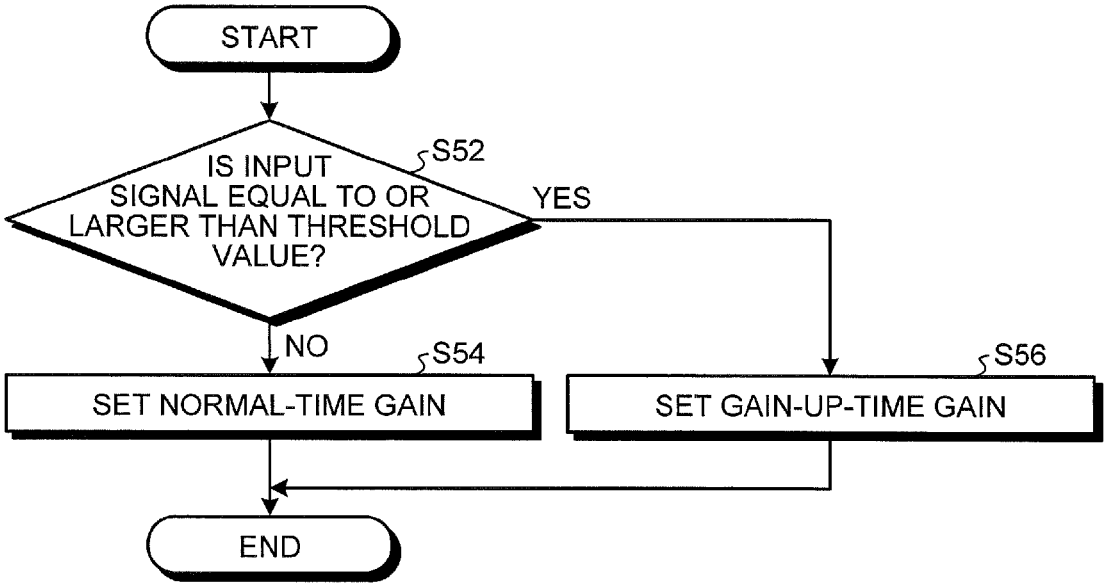
FIG. 16 is a flowchart illustrating an example of the control operation of the display device.

Next, an example of a control operation of a display device will be explained below with reference to FIGS. 15 and 16. FIGS. 15 and 16 are flowcharts illustrating an example of the control operation of the display device. The display device 10 implements the processing illustrated in FIG. 15 by performing arithmetic processing mainly by the signal processing unit 20. The display device 10 realizes the processing illustrated in FIG. 16 by performing arithmetic processing mainly by the gain-change determination unit 195.

The signal processing unit 20 divides an extended HSV color space into plural spaces (Step S12), and sets a limit proportion value for each of the divided spaces (Step S14). The signal processing unit 20 reads stored data to divide the extended HSV color space and to set the limit proportion values.

After setting the limit proportion values, the signal processing unit 20 acquires an input signal (Step S16), and decides an extension coefficient based on the acquired input signal, the extended HSV color space (a maximum value of brightness), and the limit proportion value set for a space according to the input signal (Step S18). Specifically, the processing is performed through the above steps to obtain an extension coefficient such that a proportion of an extended output signal, which exceeds the extended HSV color space (the maximum value of brightness), with respect to the extended entire output signal, does not exceed the limit proportion value.

Thereafter, the signal processing unit 20 decides an output signal of each sub-pixel based on the input signal and the extension coefficient, outputs the output signal (Step S20), and further adjusts an output of a light source (Step S22). That is, the signal processing unit 20 outputs the extended output signal to the image-display-panel drive circuit 40, and outputs a condition (1/α) of the output of the light source (the planar light-source device 50), calculated according to a result of the extension, to the filter 80 as a control signal (an input signal).

When the input signal (the control signal) (1/α) is input from the signal processing unit 20, the gain-change determination unit 195 in the filter 80 performs the processing illustrated in FIG. 16. The gain-change determination unit 195 compares the input signal (the control signal) (1/α) with a threshold value stored in the threshold-value storage unit 194. When the input signal (1/α) is determined not to be equal to or larger than the threshold value (NO at Step S52), the gain-change determination unit 195 sets normal-time gains in the multipliers 183 and 187, respectively (Step S54). That is, the gain-change determination unit 195 reads the gain $A_i$ and the gain $B_i$, associated with the number i stored in the normal-time gain-number storage unit 192, from the gain storage unit 191, sets the read gain $A_i$ as the gain A of the multiplier 183, and sets the read gain $B_i$ as the gain B of the multiplier 187.

Therefore, desired normal-time gains are set in the multipliers 183 and 187, respectively. The filter 80 performs filtering on the input signal (1/α) by a desired normal-time time constant to generate and output an output signal (a planar light-source device control signal) to the planar light-source device control circuit 60.

On the other hand, when the input signal (1/α) is determined to be equal to or larger than the threshold value (YES at Step S52), the gain-change determination unit 195 sets gain-up-time gains in the multipliers 183 and 187, respectively (Step S56). That is, the gain-change determination unit 195 reads the gain A and the gain B associated with the number j stored in the gain-up-time number storage unit 193, from the gain storage unit 191, sets the read gain $A_j$ as the gain A of the multiplier 183, and sets the read gain $B_j$ as the gain B of the multiplier 187.

Therefore, desired gain-up-time gains are set in the multipliers 183 and 187, respectively. The filter 80 performs filtering on the input signal (1/α) by a desired gain-up-time time constant to generate and output an output signal (a planar light-source device control signal) to the planar light-source device control circuit 60.

Referring back to FIG. 15, after adjusting the output of the light source, the signal processing unit 20 determines whether image display is finished (Step S24). When the signal processing unit 20 determines not to finish image display (NO at Step S24), the processing returns to Step S16. Therefore, the signal processing unit 20 repeats the processing for deciding an extension coefficient according to an input signal (an image), generating an output signal based on the extension coefficient, and adjusting the light amount of a planar light-source device according to the signal extension, until image display is finished. When the signal processing unit 20 determines to finish image display (YES at Step S24), this processing is finished.

The display device 10 can obtain the advantages described above by performing the above processing. Even in a case where the display device 10 includes a fourth sub-pixel, the display device 10 can also include a mode of displaying an image without using the fourth sub-pixel.

Modification of Gain Control Unit

Figure 17:
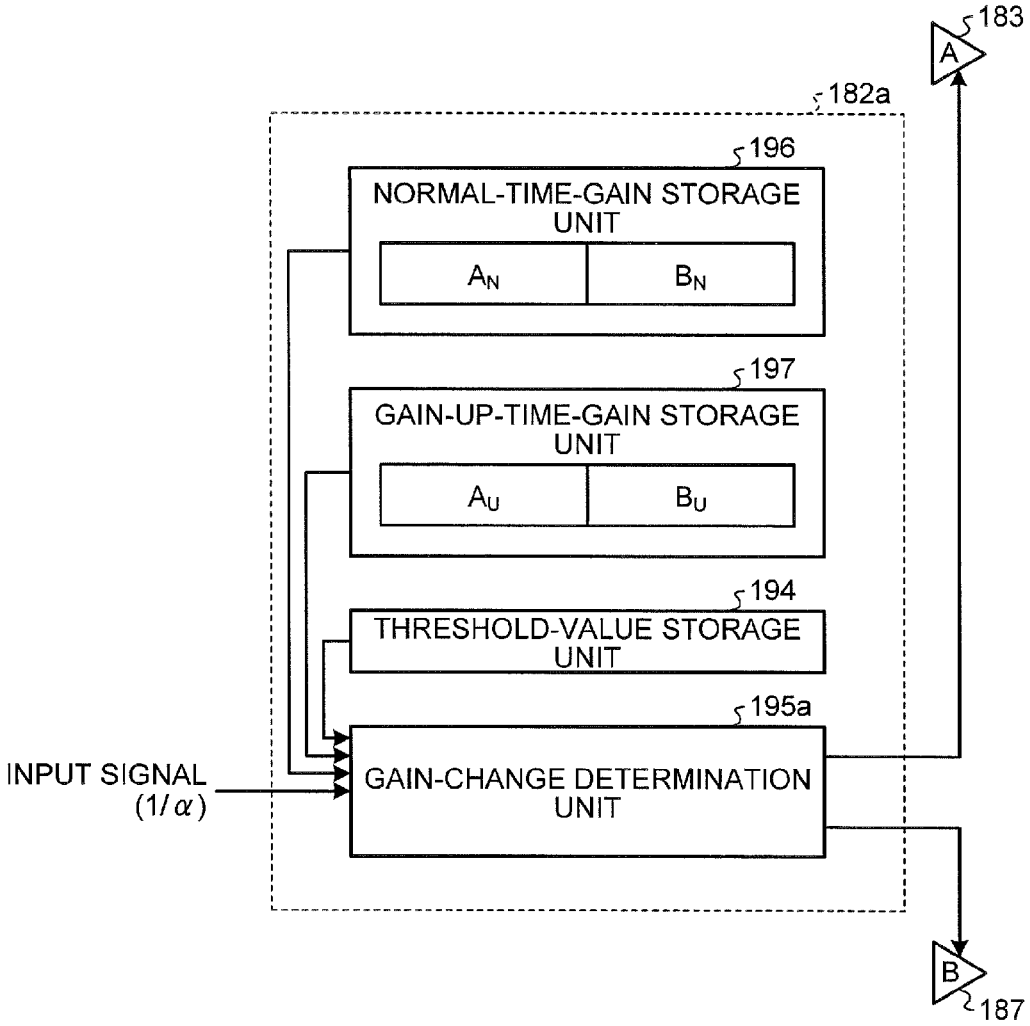
FIG. 17 is a block diagram illustrating a configuration of a modification of the gain control unit illustrated in FIG. 9.

FIG. 17 illustrates a configuration outline of a modification of a gain control unit illustrated in FIG. 9. As illustrated in FIG. 17, a gain control unit 182*a* includes the threshold-value storage unit 194, a gain-change determination unit 195*a*, a normal-time-gain storage unit 196, and a gain-up-time-gain storage unit 197.

The threshold-value storage unit 194 stores therein the threshold value Th that is a determination criterion used in setting the gain A of the multiplier 183 and the gain B of the multiplier 187. The threshold-value storage unit 194 can be a volatile memory such as a RAM. The threshold-value storage unit 194 can be a rewritable and non-volatile memory such as a flash memory. Therefore, a threshold value, which has been written once, can be used again at the time of next power-on, and accordingly rewriting of the threshold value is unnecessary.

As explained above, values of the extension coefficient $\alpha$ normally exceed 1.0, and often gather near 1.0. Therefore, it is considered to be preferable to set a threshold value approximately to 0.98 or 0.99.

When an input signal ($1/\alpha$) is smaller than the threshold value Th, that is, at the normal time, the normal-time-gain storage unit (corresponding to a first gain storage unit of the present disclosure) 196 stores therein a first gain $A_N$ that is set in the multiplier 183 as the gain A and a second gain $B_N$ that is set in the multiplier 187 as the gain B. The normal-time-gain storage unit 196 can be a volatile memory such as a RAM. The normal-time-gain storage unit 196 can be a rewritable and non-volatile memory such as a flash memory. Therefore, the gain $A_N$ and the gain $B_N$, which have been written once, can be used again at the time of next power-on, and accordingly rewriting of the gain $A_N$ and the gain $B_N$ is unnecessary. The gain $A_N$ corresponds to a first gain of the present disclosure. The gain $B_N$ corresponds to a second gain of the present disclosure.

When the input signal ($1/\alpha$) is equal to or larger than the threshold value Th, that is, at the gain-up time, the gain-up-time-gain storage unit (corresponding to a second gain storage unit of the present disclosure) 197 stores therein a third gain $A_U$ that is set in the multiplier 183 as the gain A and a fourth gain $B_U$ that is set in the multiplier 187 as the gain B. The gain-up-time-gain storage unit 197 can be a volatile memory such as a RAM. The gain-up-time-gain storage unit 197 can be a rewritable and non-volatile memory such as a flash memory. Therefore, the gain $A_U$ and the gain $B_U$, which have been written once, can be used again at the time of next power-on, and accordingly rewriting of the gain $A_U$ and the gain $B_U$ is unnecessary. The gain $A_U$ corresponds to a third gain of the present disclosure. The gain $B_U$ corresponds to a fourth gain of the present disclosure.

The gain-change determination unit 195*a* compares the input signal ($1/\alpha$) with the threshold value Th stored in the threshold-value storage unit 194. When the input signal ($1/\alpha$) is smaller than the threshold value Th, that is, at the normal time, the gain-change determination unit 195*a* reads the gain $A_N$ and the gain $B_N$ stored in the normal-time-gain storage unit 196, sets the read gain $A_N$, that is, the first gain, as the gain A of the multiplier 183, and sets the read gain $B_N$, that is, the second gain, as the gain B of the multiplier 187.

The gain-change determination unit 195*a* compares the input signal ($1/\alpha$) with the threshold value Th stored in the threshold-value storage unit 194. When the input signal ($1/\alpha$) is equal to or larger than the threshold value Th, that is, at the gain-up time, the gain-change determination unit 195*a* reads the gain $A_U$ and the gain $B_U$ stored in the gain-up-time-gain storage unit 197, sets the read gain $A_U$, that is, the third gain, as the gain A of the multiplier 183, and sets the read gain $B_U$, that is, the fourth gain, as the gain B of the multiplier 187.

When the gain $A_N$ or the gain $A_U$ is equal to the gain A that is currently set in the multiplier 183, it suffices that the gain-change determination unit 195*a* does not set the gain $A_N$ or the gain $A_U$ in the multiplier 183. Similarly, when the gain $B_N$ or the gain $B_U$ is equal to the gain B that is currently set in the multiplier 187, it suffices that the gain-change determination unit 195*a* does not set the gain $B_N$ or the gain $B_U$ in the multiplier 187.

As compared to the gain control unit 182, the gain control unit 182*a* does not need the gain storage unit 191, and therefore can reduce the storage area, the circuit size, and the mounting area, and accordingly can reduce costs.

Modification of Display Device

In a display device, plural planar light-source devices can be used in some cases such as when an image-display region is large. The present disclosure is applicable also in such a case.

Figure 18:
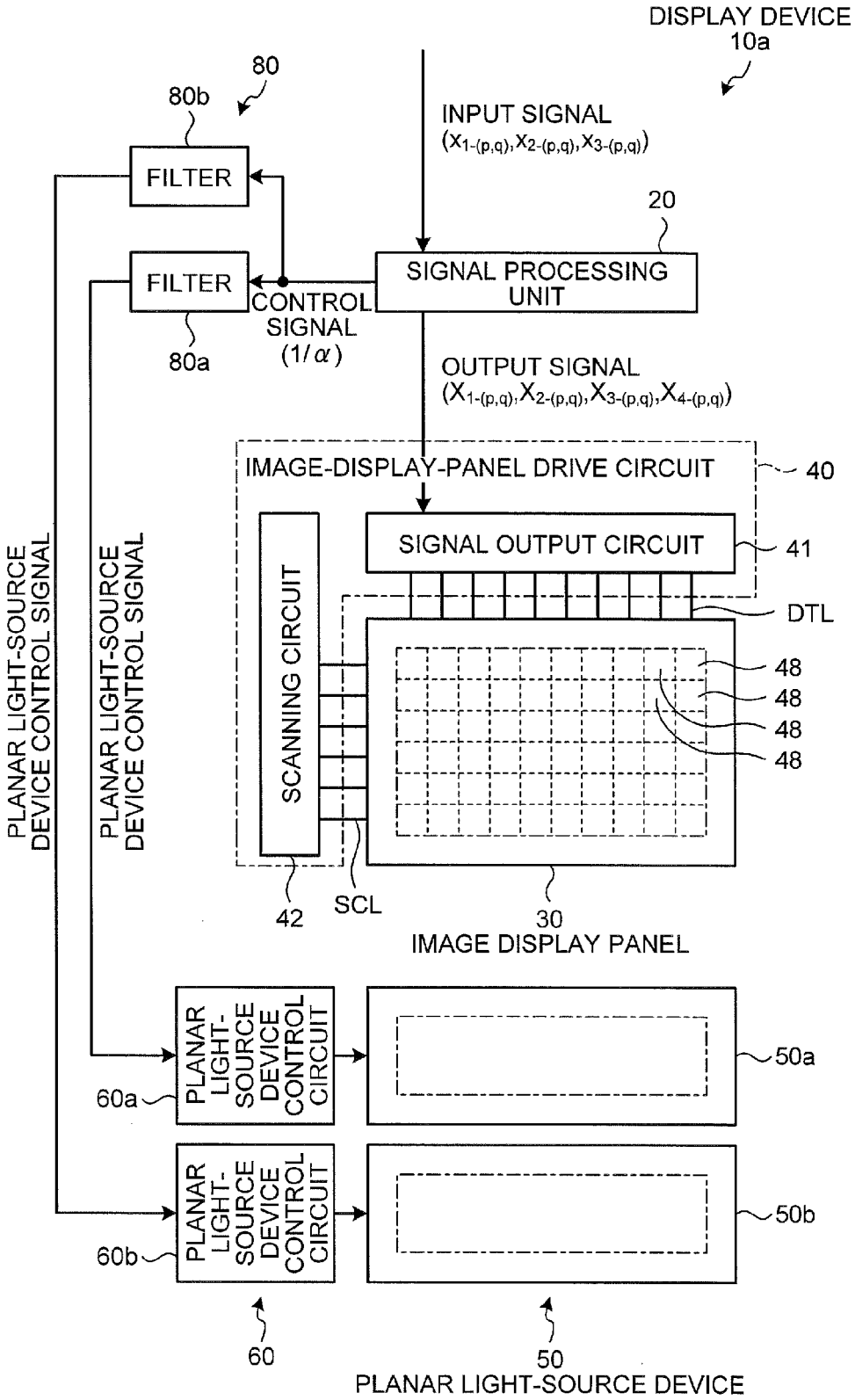
FIG. 18 is a block diagram of a configuration of a modification of the display device according to the embodiment.

FIG. 18 is a block diagram of a configuration of a modification of the display device according to the embodiment of the present disclosure. As illustrated in FIG. 18, a display device 10*a* includes the signal processing unit 20 that transmits a signal to each unit of the display device 10*a* to control an operation of each unit, the image display panel 30 that displays an image based on an output signal output from the signal processing unit 20, the image-display-panel drive circuit 40 that controls driving of the image display panel 30, the planar light-source device 50 that illuminates the image display panel 30 from its backside, the planar light-source device control circuit 60 that controls driving of the planar light-source device 50, and the filter (signal processing circuit) 80 that performs signal processing on a control signal output from the signal processing unit 20 to output the control signal to the planar light-source device control circuit 60.

The planar light-source device 50 is arranged at the backside of the image display panel 30, and irradiates light toward the image display panel 30 to illuminate the image display panel 30. The planar light-source device 50 includes plural (two in this example) planar light-source devices 50*a* and 50*b*. The planar light-source device 50*a* illuminates a half of the image display panel 30 at the upstream side in the scanning direction (at the upper side in FIG. 18). The planar light-source device 50*b* illuminates a half of the image display panel 30 at the downstream side in the scanning direction (at the lower side in FIG. 18).

The planar light-source device control circuit 60 controls the amount of light to be output from the planar light-source device 50, and the like. Specifically, based on a planar light-source device control signal that is output from the filter 80, the planar light-source device control circuit 60 adjusts the voltage to be supplied to the planar light-source device 50, and the like to control the amount of light (the light intensity) irradiated on the image display panel 30. The planar light-source device control circuit 60 includes plural (two in this example) planar light-source device control circuits 60*a* and 60*b*. The planar light-source device control circuit 60*a* controls the amount of light to be output from the planar light-source device 50*a*, and the like. The planar light-source device control circuit 60*b* controls the amount of light to be output from the planar light-source device 50*b*, and the like.

The filter (signal processing circuit) 80 performs the signal processing described above on a control signal ($1/\alpha$) that is input from the signal processing unit 20 to generate and output a planar light-source device control signal to the planar light-source device control circuit 60. The filter 80 includes plural (two in this example) filters 80*a* and 80*b*. The filter 80*a* performs the signal processing described above on the control signal ($1/\alpha$) that is input from the signal processing unit 20 to generate and output a planar light-source device control signal to the planar light-source device control circuit 60*a*. The filter 80*b* performs the signal processing described above on the control signal ($1/\alpha$) that is input from the signal processing unit 20 to generate and output a planar light-source device control signal to the planar light-source device control circuit 60*b*. The circuit configuration of the filters 80*a* and 80*b* is the same as that previously explained in FIG. 9.

As described above, in the display device 10*a* using the planar light-source devices 50*a* and 50*b*, the filters 80*a* and 80*b* are provided corresponding to the planar light-source devices 50*a* and 50*b*, respectively. Each of the filters 80*a* and 80*b* is configured in a very small circuit size as illustrated in FIG. 9. Therefore, even in a case where the display device 10*a* includes the filters 80*a* and 80*b*, the display device 10*a* can still reduce the circuit size and the mounting area, and accordingly reduce costs.

2. Application Example

Next, application examples of the display device 10 according to the above embodiment will be explained below. It is possible to apply the display device 10 according to the embodiment to electronic apparatuses in any field, including a portable phone, a portable terminal device such as a smartphone, a television device, a digital camera, a laptop personal computer, a video camera, meters provided in a vehicle, and the like. In other words, it is possible to apply the display device 10 according to the present embodiment to electronic apparatuses in any field, which display a video signal input externally or a video signal generated internally as an image or a video. The electronic apparatuses include a control device that supplies a video signal to the display device to control an operation of the display device.

Application Example 1

Figure 19:
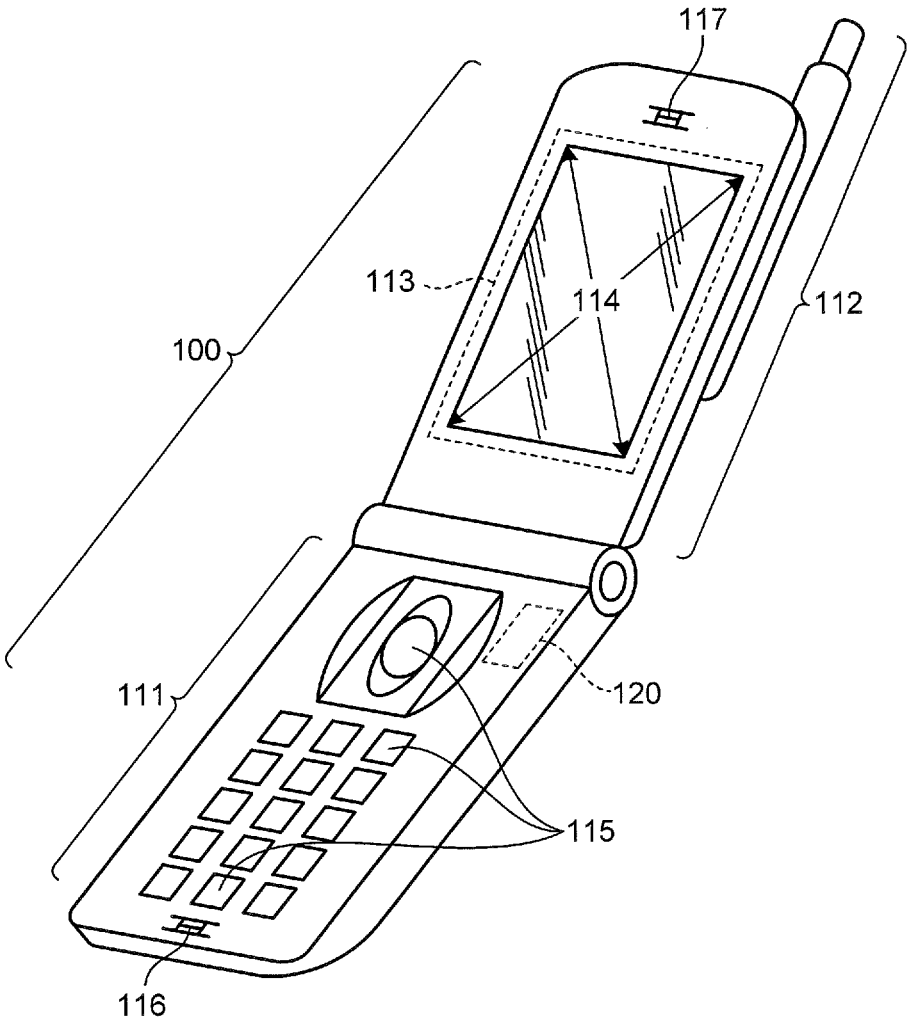
FIG. 19 is a perspective view of a configuration example of an electronic apparatus according to an application example 1.

FIG. 19 is a perspective view of a configuration example of an electronic apparatus according to an application example 1. An electronic apparatus 100 is a portable phone, and includes, for example, a main unit 111 and a display body 112 that is provided to be capable of being opened from and closed to the main unit 111 as illustrated in FIG. 19. The main unit 111 includes an operation button 115 and a transmitter 116. The electronic apparatus 100 has a control device 120 that is incorporated therein to control the electronic apparatus 100 in its entirety. The display body 112 includes a display device 113 and a receiver 117. The display device 113 performs various kinds of display regarding telephone communication on a display screen 114 of the display device 113. The electronic apparatus 100 includes a control unit (not illustrated) that controls an operation of the display device 113. This control unit is provided in the interior of the main unit 111 as a part of the control device 120, or is provided in the interior of the display body 112 separately from the control device 120. The control device 120 that controls the electronic apparatus 100 in its entirety supplies a video signal to the control unit of the display device 113. That is, the control device 120 decides a video to be displayed by the electronic apparatus 100, and transmits a video signal of the decided video to the control unit of the display device 113 to cause the display device 113 to display the decided video.

The display device 113 has the same configuration as the display device 10 according to the above embodiment. Therefore, the display device 113 can achieve low power consumption, while suppressing reduction in display quality.

Examples of an electronic apparatus, to which the display device 10 according to the above embodiment is applicable, include a clock with a display device, a watch with a display device, a personal computer, a liquid crystal television, a viewfinder-type or monitor direct-view-type videotape recorder, a car navigation device, a pager, an electronic organizer, a calculator, a word processor, a workstation, a videophone, and a POS terminal device, in addition to the portable phone explained above.

Figure 20:
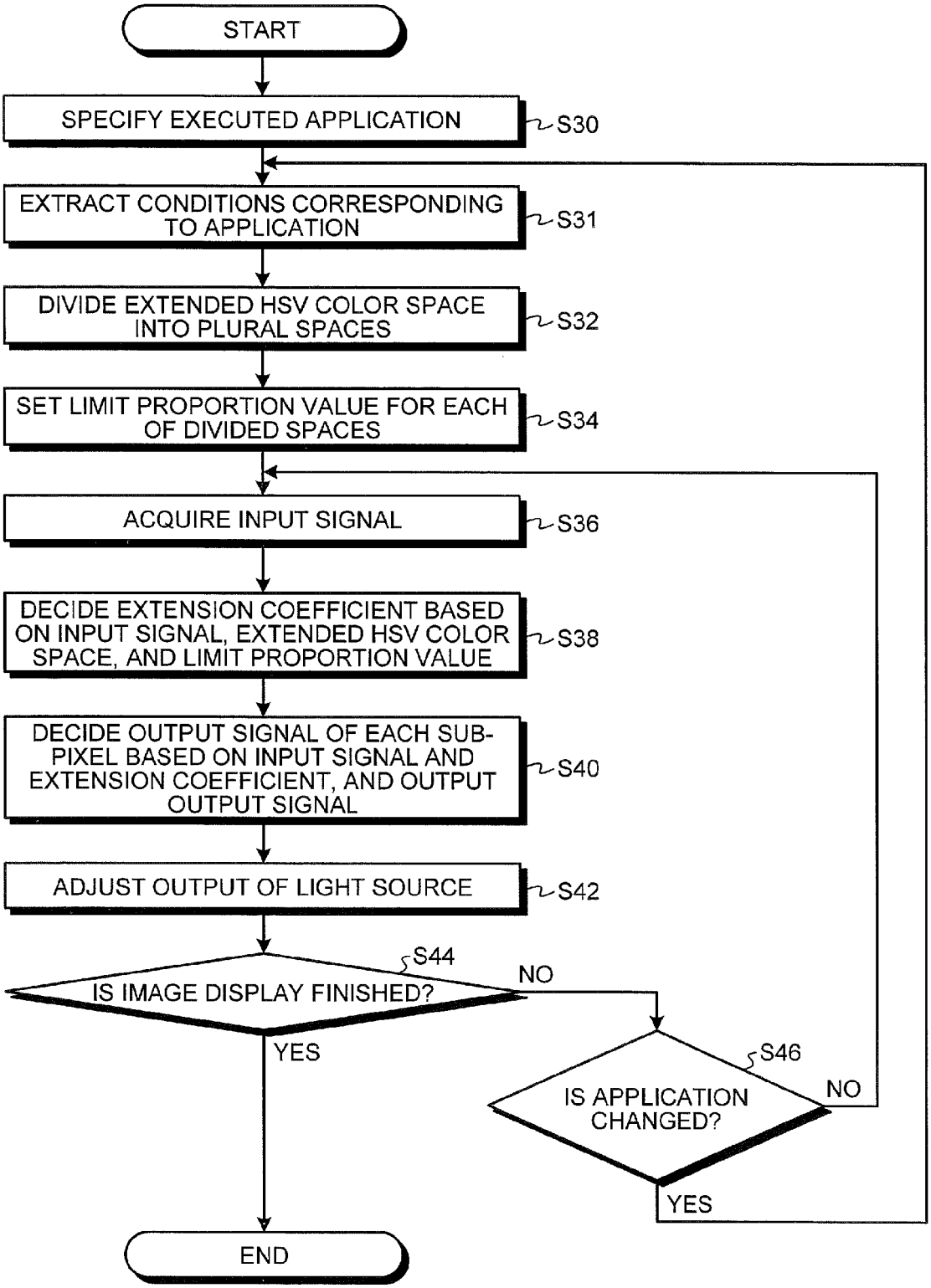
FIG. 20 is a flowchart illustrating an example of a control operation of the electronic apparatus.

The electronic apparatus may change data (hereinafter, "conditions") that shows a rule for dividing an extended HSV color space into plural spaces and information regarding a limit proportion value set for each of the divided spaces according to an image-displaying application (software and function). FIG. 20 is a flowchart illustrating an example of a control operation of an electronic apparatus. The electronic apparatus 100 implements the processing illustrated in FIG. 20 by performing arithmetic processing mainly by the signal processing unit 20 in the display device 113 and by the control device 120.

The control device 120 specifies an executed application (Step S30), and extracts conditions that correspond to the application (Step S31).

Next, the display device 113 divides an extended HSV color space into plural spaces (Step S32), and sets a limit proportion value for each of the divided spaces (Step S34). The display device 113 reads stored data to divide the color space and to set the limit proportion values.

After setting the limit proportion values, the display device 113 acquires an input signal (Step S36), and decides an extension coefficient based on the acquired input signal, the extended HSV color space (a maximum value of brightness), and the limit proportion value (Step S38) set for a space according to the input signal. Specifically, the processing is performed through the above steps to obtain an extension coefficient such that a proportion of an extended output signal, which exceeds the extended HSV color space (the maximum value of brightness), with respect to the extended entire output signal, does not exceed the limit proportion value.

Thereafter, the display device 113 decides an output signal of each sub-pixel based on the input signal and the extension coefficient, outputs the output signal (Step S40), and further adjusts an output of a light source (Step S42). After adjusting the output of the light source, the display device 113 determines whether image display is finished (Step S44). When the electronic apparatus 100 determines not to finish image display (NO at Step S44), the display device 113 and the control device 120 determine whether the application is changed (Step S46). When the control device 120 determines that the application is changed (YES at Step S46), the processing returns to Step S31, and the conditions are changed. When the control device 120 determines that the application is not changed (NO at Step S46), the processing returns to Step S36. Therefore, the electronic apparatus 100 repeats the processing for deciding an extension coefficient according to an input signal (an image), generating an output signal based on the extension coefficient, and adjusting the light amount of a planar light-source device according to the signal extension, until image display is finished. When the application is changed, the electronic apparatus 100 can extend the input signal based on the conditions of a changed application. When the electronic apparatus 100 determines to finish image display (YES at Step S44), this processing is finished.

The electronic apparatus 100 can obtain the advantages described above by performing the above processing. The electronic apparatus 100 changes the conditions according to the change of the application, and therefore can increase the extension coefficient when display quality degradation is allowed, and can decrease the extension coefficient when high display quality is required, for example. This can satisfy the intended use of the electronic apparatus 100, and further can maintain the display quality and reduce power consumption.

Application Example 2

Figure 21:
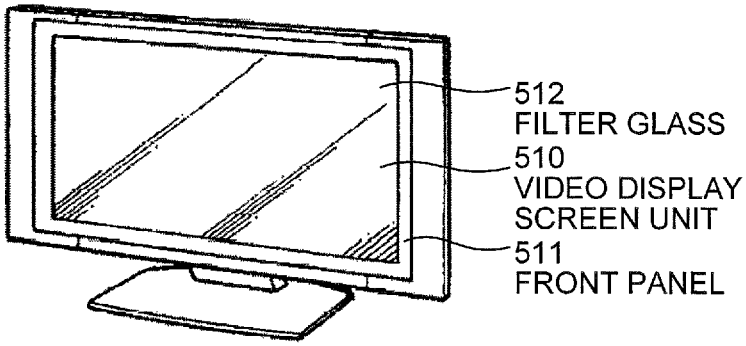
FIG. 21 illustrates a television device to which the display device according to the embodiment is applied.

FIG. 21 illustrates a television device to which the display device according to the embodiment is applied. This television device includes a video display screen unit 510 that includes a front panel 511 and a filter glass 512, for example. The video display screen unit 510 is the display device according to the embodiment.

Application Example 3

Figure 22:
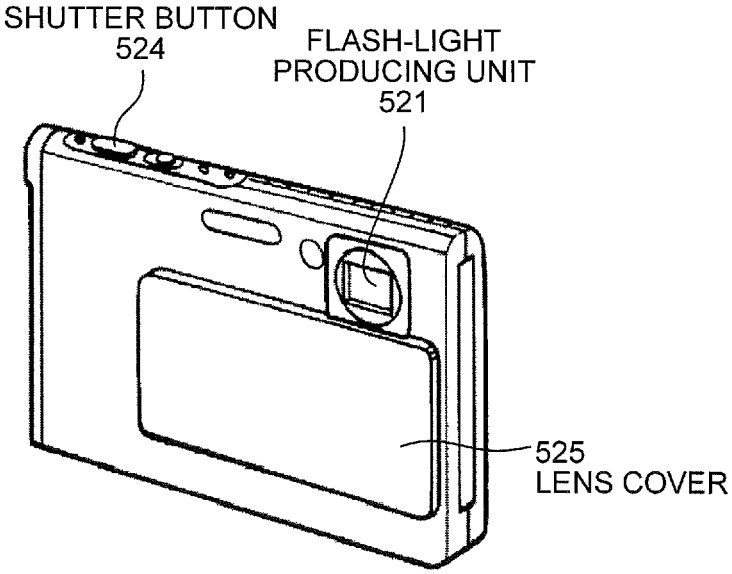
FIG. 22 illustrates a digital camera to which the display device according to the embodiment is applied.
Figure 23:
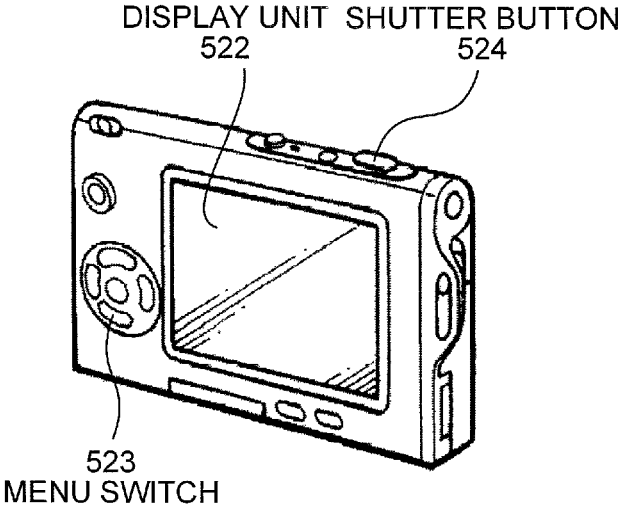
FIG. 23 illustrates the digital camera to which the display device according to the embodiment is applied.

FIGS. 22 and 23 illustrate a digital camera to which the display device according to the embodiment is applied. This digital camera includes a flash-light producing unit 521, a display unit 522, a menu switch 523, and a shutter button 524, for example. The display unit 522 is the display device according to the embodiment. As illustrated in FIG. 22, the digital camera includes a lens cover 525, and can slide the lens cover 525 to expose an image-capturing lens. A digital camera can image light incident from its image-capturing lens to capture a digital photograph.

Application Example 4

Figure 24:
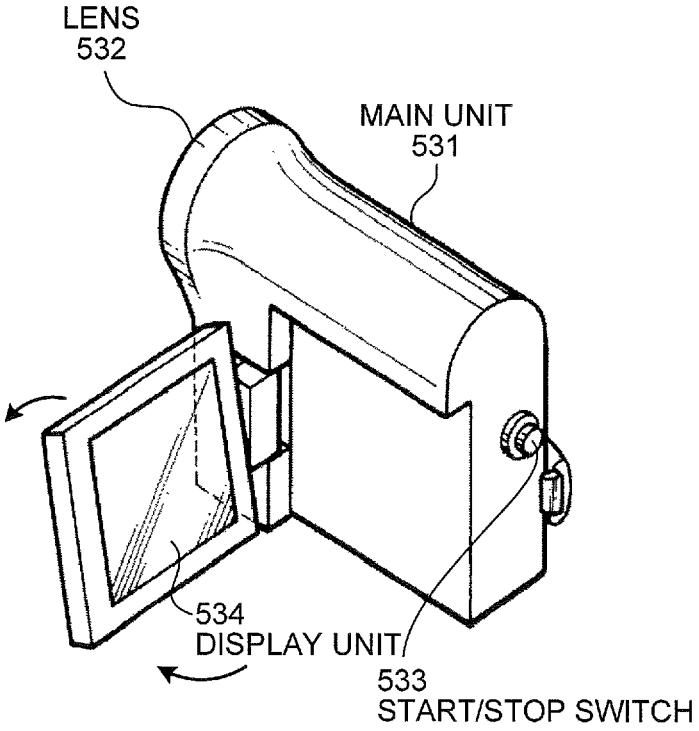
FIG. 24 illustrates an external appearance of a video camera to which the display device according to the embodiment is applied.

FIG. 24 illustrates the external appearance of a video camera to which the display device according to the embodiment is applied. This video camera includes a main unit 531, a subject capturing lens 532 that is provided on the front side of the main unit 531, an image-capturing start/stop switch 533, and a display unit 534, for example. The display unit 534 is the display device according to the embodiment.

Application Example 5

Figure 25:
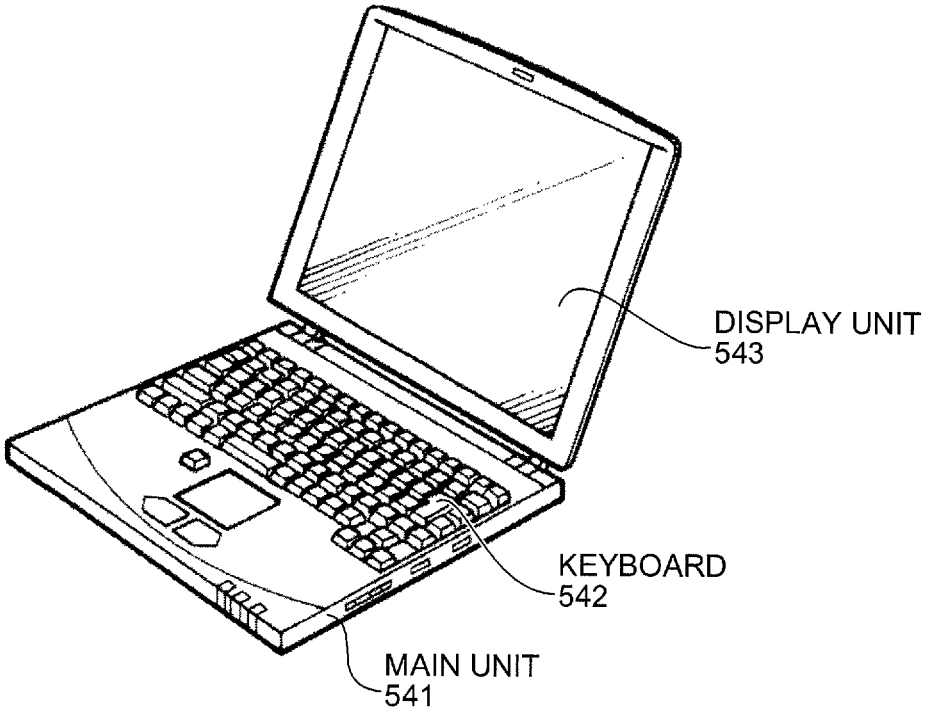
FIG. 25 illustrates a laptop personal computer to which the display device according to the embodiment is applied.

FIG. 25 illustrates a laptop personal computer to which the display device according to the embodiment is applied. This laptop personal computer includes a main unit 541, a keyboard 542 for an operation to input text and the like, and a display unit 543 that displays an image. The display unit 543 is configured by the display device according to the embodiment.

Application Example 6

Figure 26:
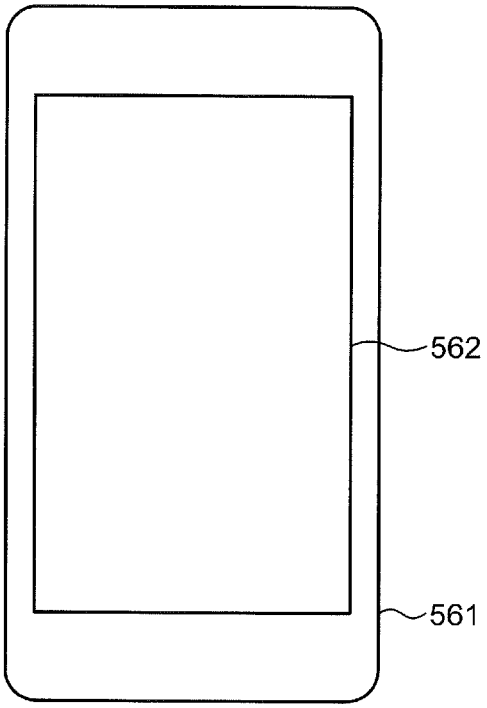
FIG. 26 illustrates a portable information terminal to which the display device according to the embodiment is applied.

FIG. 26 illustrates a portable information terminal that operates as a portable computer, a multi-functional portable phone, a portable computer capable of making a voice call, or a portable computer capable of other forms of communication, and that is also referred to as "smartphone" or "tablet terminal". This portable information terminal includes a display unit 562 on a surface of a casing 561, for example. The display unit 562 is the display device according to the embodiment.

3. Aspects of the Present Disclosure

The present disclosure includes the following aspects.

(1) A display device comprising:

an image display panel in which pixels are arrayed in a two-dimensional matrix, each of the pixels including a first sub-pixel that displays a first color, a second sub-pixel that displays a second color, a third sub-pixel that displays a third color, and a fourth sub-pixel that displays a fourth color;

a signal processing unit that converts an input value of an input HSV color space of an input signal into an extension value of an extended HSV color space that is extended by the first color, the second color, the third color, and the fourth color to generate an output signal of the extension value, that outputs the generated output signal to the image display panel, and that outputs a control signal for controlling luminance of the image display panel; and a signal processing circuit that performs signal processing on the control signal to output a light-source device control signal for controlling a light-source device that illuminates the image display panel, wherein the signal processing unit calculates an extension coefficient $\alpha$ for the input signal, calculates an output signal of the first sub-pixel based on at least an input signal of the first sub-pixel and the extension coefficient $\alpha$, and outputs the output signal to the first sub-pixel, calculates an output signal of the second sub-pixel based on at least an input signal of the second sub-pixel and the extension coefficient $\alpha$, and outputs the output signal to the second sub-pixel, calculates an output signal of the third sub-pixel based on at least an input signal of the third sub-pixel and the extension coefficient $\alpha$, and outputs the output signal to the third sub-pixel, calculates an output signal of the fourth sub-pixel based on the input signal of the first sub-pixel, the input signal of the second sub-pixel, and the input signal of the third sub-pixel, and outputs the output signal to the fourth sub-pixel, and calculates the control signal based on at least the extension coefficient $\alpha$, and outputs the control signal to the signal processing circuit, and the signal processing circuit performs filtering processing on the control signal by a set first time constant to calculate and output the light-source device control signal, when the control signal is smaller than a set threshold value, and performs filtering processing on the control signal by a set second time constant to calculate and output the light-source device control signal, when the control signal is equal to or larger than the threshold value.

(2) The display device according to (1), wherein the signal processing circuit includes a first multiplier, a second multiplier, an adder, a delay circuit, and a gain control unit, the first multiplier multiplies the control signal by a gain A, the second multiplier multiplies an output signal of the delay circuit by a gain B, the adder adds an output signal of the first multiplier and an output signal of the second multiplier together, the delay circuit delays an output signal of the adder by one frame time, and the gain control unit sets a set first gain in the first multiplier as the gain A and sets a set second gain in the second multiplier as the gain B, when the control signal is smaller than the threshold value, and sets a set third gain in the first multiplier as the gain A and sets a set fourth gain in the second multiplier as the gain B, when the control signal is equal to or larger than the threshold value.

(3) The display device according to (2), wherein the gain control unit includes a gain storage unit that stores therein a plurality of sets of gains, each of the sets of gains includes two gains, a first information storage unit that has first information for selecting one set of gains among the sets of gains set therein when the control signal is smaller than the threshold value, a second information storage unit that has second information for selecting one set of gains among the sets of gains set therein when the control signal is equal to or larger than the threshold value, and a gain-change determination unit that selects one set of gains among the sets of gains as the first and second gains based on the first information set in the first information storage unit, and sets the first and second gains in the first and second multipliers as the gain A and the gain B, respectively, when the control signal is smaller than the threshold value, and that selects one set of gains among the sets of gains as the third and fourth gains based on the second information set in the second information storage unit, and sets the third and fourth gains in the first and second multipliers as the gain A and the gain B, respectively, when the control signal is equal to or larger than the threshold value.

(4) The display device according to (2), wherein the gain control unit includes a first gain storage unit that has the first and second gains set therein, a second gain storage unit that has the third and fourth gains set therein, and a gain-change determination unit that sets the first and second gains set in the first gain storage unit, in the first and second multipliers as the gain A and the gain B, respectively, when the control signal is smaller than the threshold value, and that sets the third and fourth gains set in the second gain storage unit, in the first and second multipliers as the gain A and the gain B, respectively, when the control signal is equal to or larger than the threshold value.

(5) The display device according to (1), wherein the image display panel is illuminated by a plurality of light-source devices, and the display device comprises a plurality of the signal processing circuits that output the light-source device control signal respectively to the light-source devices based on the control signal.

(6) The display device according to (1), wherein the signal processing unit sets a limit proportion value for the extended HSV color space, the limit proportion value being an upper limit of a proportion of a range that exceeds a maximum value of brightness in the extended HSV color space in a combination of hue and saturation value to the maximum value, and the signal processing unit calculates an extension coefficient $\alpha$ for the input signal within a range where a value exceeding the maximum value of brightness, among values obtained by performing multiplication on brightness of each sub-pixel signal in the input signal by the extension coefficient $\alpha$, does not exceed a value obtained by multiplying the maximum value of brightness by the limit proportion value.

(7) The display device according to (6), wherein the signal processing unit divides the extended HSV color space into a plurality of spaces by at least one of saturation, brightness, and hue, and sets different values for at least two of the divided spaces as a limit proportion value that is an upper limit of a proportion of a range that exceeds a maximum value of brightness in the extended HSV color space in a combination of hue and saturation values to the maximum value.

(8) The display device according to (7), wherein the signal processing unit divides the extended HSV color space into two or more spaces based on the saturation as a reference.

(9) The display device according to (7), wherein the signal processing unit divides the extended HSV color space into two or more spaces based on the hue as a reference.

(10) The display device according to (7), wherein the signal processing unit divides the extended HSV color space into two or more spaces based on the brightness as a reference.

(11) The display device according to (1), wherein the fourth color is white.

(12) An electronic apparatus comprising:

the display device according to (1); and a control device that supplies the input signal to the display device.

(13) A driving method of a display device that includes an image display panel in which pixels are arrayed in a two-dimensional matrix, where each of the pixels includes a first sub-pixel that displays a first color, a second sub-pixel that displays a second color, a third sub-pixel that displays a third color, and a fourth sub-pixel that displays a fourth color, a signal processing unit that converts an input value of an input HSV color space of an input signal into an extension value of an extended HSV color space that is extended by the first color, the second color, the third color, and the fourth color to generate an output signal of the extension value, that outputs the generated output signal to the image display panel, and that outputs a control signal for controlling luminance of the image display panel, and a signal processing circuit that performs signal processing on the control signal to output a light-source device control signal for controlling a light-source device that illuminates the image display panel, the driving method comprising:

calculating an extension coefficient $\alpha$ for the input signal;

calculating an output signal of the first sub-pixel based on at least an input signal of the first sub-pixel and the extension coefficient $\alpha$, and outputting the output signal to the first sub-pixel, calculating an output signal of the second sub-pixel based on at least an input signal of the second sub-pixel and the extension coefficient $\alpha$, and outputting the output signal to the second sub-pixel, calculating an output signal of the third sub-pixel based on at least an input signal of the third sub-pixel and the extension coefficient $\alpha$, and outputting the output signal to the third sub-pixel, calculating an output signal of the fourth sub-pixel based on the input signal of the first sub-pixel, the input signal of the second sub-pixel, and the input signal of the third sub-pixel, and outputting the output signal to the fourth sub-pixel; and performing filtering processing on the control signal by a set first time constant to calculate and output the light-source device control signal, when the control signal is smaller than a set threshold value, and performing filtering processing on the control signal by a set second time constant to calculate and output the light-source device control signal, when the control signal is equal to or larger than the threshold value.

(14) A signal processing method in a display device that includes an image display panel in which pixels are arrayed in a two-dimensional matrix, where each of the pixels includes a first sub-pixel that displays a first color, a second sub-pixel that displays a second color, a third sub-pixel that displays a third color, and a fourth sub-pixel that displays a fourth color, a signal processing unit that converts an input value of an input HSV color space of an input signal into an extension value of an extended HSV color space that is extended by the first color, the second color, the third color, and the fourth color to generate an output signal of the extension value, that outputs the generated output signal to the image display panel, and that outputs a control signal for controlling luminance of the image display panel, and a signal processing circuit that performs signal processing on the control signal to output a light-source device control signal for controlling a light-source device that illuminates the image display panel, where the signal processing unit calculates an extension coefficient $\alpha$ for the input signal, and calculates the control signal based on at least the extension coefficient α, the signal processing method being executed by the signal processing circuit, wherein when the control signal is smaller than a set threshold value, filtering processing is performed on the control signal by a set first time constant to calculate and output the light-source device control signal, and when the control signal is equal to or larger than the threshold value, filtering processing is performed on the control signal by a set second time constant to calculate and output the light-source device control signal.

What is claimed is:

1. A display device comprising:

an image display panel in which pixels are arrayed in a two-dimensional matrix, each of the pixels including a first sub-pixel that displays a first color, a second sub-pixel that displays a second color, a third sub-pixel that displays a third color, and a fourth sub-pixel that displays a fourth color;

a signal processing unit that converts an input value of an input HSV color space of an input signal into an extension value of an extended HSV color space that is extended by the first color, the second color, the third color, and the fourth color to generate an output signal of the extension value, that outputs the generated output signal to the image display panel, and that outputs a control signal for controlling luminance of the image display panel; and a signal processing circuit that performs signal processing on the control signal to output a light-source device control signal for controlling a light-source device that illuminates the image display panel, wherein the signal processing unit calculates an extension coefficient α for the input signal, calculates an output signal of the first sub-pixel based on at least an input signal of the first sub-pixel and the extension coefficient α, and outputs the output signal to the first sub-pixel, calculates an output signal of the second sub-pixel based on at least an input signal of the second sub-pixel and the extension coefficient α, and outputs the output signal to the second sub-pixel, calculates an output signal of the third sub-pixel based on at least an input signal of the third sub-pixel and the extension coefficient α, and outputs the output signal to the third sub-pixel, calculates an output signal of the fourth sub-pixel based on the input signal of the first sub-pixel, the input signal of the second sub-pixel, and the input signal of the third sub-pixel, and outputs the output signal to the fourth sub-pixel, and calculates the control signal based on at least the extension coefficient α, and outputs the control signal to the signal processing circuit, the signal processing circuit performs filtering processing on the control signal by a set first time constant to calculate and output the light-source device control signal, when the control signal is smaller than a set threshold value, and performs filtering processing on the control signal by a set second time constant to calculate and output the light-source device control signal, when the control signal is equal to or larger than the threshold value, and the signal processing unit outputs a reciprocal (1/α) of the extension coefficient α to the signal processing circuit, the reciprocal (1/α) being the control signal.

2. The display device according to claim 1, wherein the signal processing circuit includes a first multiplier, a second multiplier, an adder, a delay circuit, and a gain control unit, the first multiplier multiplies the control signal by a gain A, the second multiplier multiplies an output signal of the delay circuit by a gain B, the adder adds an output signal of the first multiplier and an output signal of the second multiplier together, the delay circuit delays an output signal of the adder by one frame time, and the gain control unit sets a set first gain in the first multiplier as the gain A and sets a set second gain in the second multiplier as the gain B, when the control signal is smaller than the threshold value, and sets a set third gain in the first multiplier as the gain A and sets a set fourth gain in the second multiplier as the gain B, when the control signal is equal to or larger than the threshold value.

3. The display device according to claim 2, wherein the gain control unit includes a gain storage unit that stores therein a plurality of sets of gains, each of the sets of gains includes two gains, a first information storage unit that has first information for selecting one set of gains among the sets of gains set therein when the control signal is smaller than the threshold value, a second information storage unit that has second information for selecting one set of gains among the sets of gains set therein when the control signal is equal to or larger than the threshold value, and a gain-change determination unit that selects one set of gains among the sets of gains as the first and second gains based on the first information set in the first information storage unit, and sets the first and second gains in the first and second multipliers as the gain A and the gain B, respectively, when the control signal is smaller than the threshold value, and that selects one set of gains among the sets of gains as the third and fourth gains based on the second information set in the second information storage unit, and sets the third and fourth gains in the first and second multipliers as the gain A and the gain B, respectively, when the control signal is equal to or larger than the threshold value.

4. The display device according to claim 2, wherein the gain control unit includes a first gain storage unit that has the first and second gains set therein, a second gain storage unit that has the third and fourth gains set therein, and a gain-change determination unit that sets the first and second gains set in the first gain storage unit, in the first and second multipliers as the gain A and the gain B, respectively, when the control signal is smaller than the threshold value, and that sets the third and fourth gains set in the second gain storage unit, in the first and second multipliers as the gain A and the gain B, respectively, when the control signal is equal to or larger than the threshold value.

5. The display device according to claim 1, wherein the image display panel is illuminated by a plurality of light-source devices, and the display device comprises a plurality of the signal processing circuits that output the light-source device control signal respectively to the light-source devices based on the control signal.

6. The display device according to claim 1, wherein the signal processing unit sets a limit proportion value for the extended HSV color space, the limit proportion value being an upper limit of a proportion of a range that exceeds a maximum value of brightness in the extended HSV color space in a combination of hue and saturation value to the maximum value, and the signal processing unit calculates an extension coefficient α for the input signal within a range where a value exceeding the maximum value of brightness, among values obtained by performing multiplication on brightness of each sub-pixel signal in the input signal by the extension coefficient α, does not exceed a value obtained by multiplying the maximum value of brightness by the limit proportion value.

7. The display device according to claim 6, wherein the signal processing unit divides the extended HSV color space into a plurality of spaces by at least one of saturation, brightness, and hue, and sets different values for at least two of the divided spaces as a limit proportion value that is an upper limit of a proportion of a range that exceeds a maximum value of brightness in the extended HSV color space in a combination of hue and saturation values to the maximum value.

8. The display device according to claim 7, wherein the signal processing unit divides the extended HSV color space into two or more spaces based on the saturation as a reference.

9. The display device according to claim 7, wherein the signal processing unit divides the extended HSV color space into two or more spaces based on the hue as a reference.

10. The display device according to claim 7, wherein the signal processing unit divides the extended HSV color space into two or more spaces based on the brightness as a reference.

11. The display device according to claim 1, wherein the fourth color is white.

12. An electronic apparatus comprising:

the display device according to claim 1; and a control device that supplies the input signal to the display device.

13. A driving method of a display device that includes an image display panel in which pixels are arrayed in a two-dimensional matrix, where each of the pixels includes a first sub-pixel that displays a first color, a second sub-pixel that displays a second color, a third sub-pixel that displays a third color, and a fourth sub-pixel that displays a fourth color, a signal processing unit that converts an input value of an input HSV color space of an input signal into an extension value of an extended HSV color space that is extended by the first color, the second color, the third color, and the fourth color to generate an output signal of the extension value, that outputs the generated output signal to the image display panel, and that outputs a control signal for controlling luminance of the image display panel, and a signal processing circuit that performs signal processing on the control signal to output a light-source device control signal for controlling a light-source device that illuminates the image display panel, the driving method comprising:

calculating an extension coefficient α for the input signal;

calculating an output signal of the first sub-pixel based on at least an input signal of the first sub-pixel and the extension coefficient α, and outputting the output signal to the first sub-pixel, calculating an output signal of the second sub-pixel based on at least an input signal of the second sub-pixel and the extension coefficient α, and outputting the output signal to the second sub-pixel, calculating an output signal of the third sub-pixel based on at least an input signal of the third sub-pixel and the extension coefficient α, and outputting the output signal to the third sub-pixel, calculating an output signal of the fourth sub-pixel based on the input signal of the first sub-pixel, the input signal of the second sub-pixel, and the input signal of the third sub-pixel, and outputting the output signal to the fourth sub-pixel;

outputting a reciprocal (1/α) of the extension coefficient α, the reciprocal (1/α) being the control signal; and performing filtering processing on the control signal by a set first time constant to calculate and output the light-source device control signal, when the control signal is smaller than a set threshold value, and performing filtering processing on the control signal by a set second time constant to calculate and output the light-source device control signal, when the control signal is equal to or larger than the threshold value.

14. A signal processing method in a display device that includes an image display panel in which pixels are arrayed in a two-dimensional matrix, where each of the pixels includes a first sub-pixel that displays a first color, a second sub-pixel that displays a second color, a third sub-pixel that displays a third color, and a fourth sub-pixel that displays a fourth color, a signal processing unit that converts an input value of an input HSV color space of an input signal into an extension value of an extended HSV color space that is extended by the first color, the second color, the third color, and the fourth color to generate an output signal of the extension value, that outputs the generated output signal to the image display panel, and that outputs a control signal for controlling luminance of the image display panel, and a signal processing circuit that performs signal processing on the control signal to output a light-source device control signal for controlling a light-source device that illuminates the image display panel, where the signal processing unit calculates an extension coefficient α for the input signal, and calculates a reciprocal (1/α) of the extension coefficient α, the reciprocal (1/α) being the control signal, the signal processing method being executed by the signal processing circuit, wherein when the control signal is smaller than a set threshold value, filtering processing is performed on the control signal by a set first time constant to calculate and output the light-source device control signal, and when the control signal is equal to or larger than the threshold value, filtering processing is performed on the control signal by a set second time constant to calculate and output the light-source device control signal.

* * * * *